US006007425A

United States Patent [19]

Takemoto et al.

[11] Patent Number: 6,007,425

[45] Date of Patent: Dec. 28, 1999

[54] SIMULATION SYSTEM FOR PLACE OF AMUSEMENT

[75] Inventors: Takatoshi Takemoto; Hiroshi Hirano, both of Tokyo, Japan

[73] Assignee: Kabushiki Kaisha Ace Denken, Japan

[21] Appl. No.: 08/945,786

[22] PCT Filed: May 1, 1996

[86] PCT No.: PCT/JP96/01192

§ 371 Date: Oct. 31, 1997

§ 102(e) Date: Oct. 31, 1997

[87] PCT Pub. No.: WO96/34667

PCT Pub. Date: Nov. 7, 1996

[30] Foreign Application Priority Data

May 2, 1995 [JP] Japan ..... 7-131222

[51] Int. Cl.[6] ..... A63F 9/22

[52] U.S. Cl. ..... 463/16; 700/500; 700/10; 700/7; 434/72

[58] Field of Search ..... 434/72–80; 463/12, 463/13, 16, 20, 25; 705/500, 400, 30, 10, 7, 1

[56] References Cited

U.S. PATENT DOCUMENTS

| | | | |
|---|---|---|---|
| 4,531,187 | 7/1985 | Uhland | 463/12 |
| 4,642,780 | 2/1987 | Thornson | 434/72 X |
| 4,931,929 | 6/1990 | Sherman | 705/500 |
| 4,947,322 | 8/1990 | Tenura et al. | 434/72 X |

FOREIGN PATENT DOCUMENTS

| | | |
|---|---|---|
| 5-282280 | 10/1993 | Japan . |
| 6-176004 | 6/1994 | Japan . |
| 6-290163 | 10/1994 | Japan . |

*Primary Examiner*—Michael O'Neill
*Attorney, Agent, or Firm*—Seed and Berry LLP

[57] ABSTRACT

The present invention provides a simulation system for an amusement arcade, which generates a dynamic model relating to the amusement arcade and can inspect an operating condition of play machines, a flow of players and the like. This system comprises a parameter setting unit (12) having a play machine information setting unit for setting a parameter, which defines a construction of play machines constituting the amusement arcade, and a player information setting unit for setting a parameter, which defines properties of players who use play machines, a simulation executing unit (16) for executing simulation for each unit time of the amusement arcade on the basis of parameters set by the parameter setting unit (12), a result analyzing unit (21) for generating data indicative of a result of simulation on the basis of data obtained by simulation executed for a predetermined unit time, and a display unit (20) for indicating a picture corresponding to data obtained by the result analyzing unit (21).

16 Claims, 21 Drawing Sheets

-------- PARLOR SIMULATION SYSTEM --------

--- REPORT OF THE WHOLE OF PARLOR ---

TOTAL OF PINBALL MACHINES 290

| | INDEPENDENT ISLAND RESTORATION METHOD | OVERALL RESTORATION METHOD | |
|---|---|---|---|
| NUMBER OF OPERATING TABLES: | 140 | 150 | |
| TOTAL OF LENT BALLS: | 5275250 | 5065125 | |
| TOTAL OF GIVEAWAY BALLS: | 6176919 | 5982759 | |
| *: | 117 | 118 | *: RATIO OF THE NUMBER OF GIVEAWAY BALLS TO THE NUMBER OF LENT BALLS AT CLOSING TIME |
| NUMBER OF INCOMING BALLS: | 9357472 | 8970037 | |
| **: | −901669 | −917634 | **: NUMBER OF DIFFERENCE BETWEEN NUMBERS OF INCOMING BALLS AND OUTGOING BALLS |
| RATE OF OUTGOING BALLS: | 110 | 110 | |
| TOTAL NUMBER OF TIMES OF SPECIAL PRIZE: | 20 | 18 | |
| G VALUE: | 42 | 42 | ***: RATIO OF THE NUMBER OF GIVEAWAY BALLS TO THE NUMBER OF LENT BALLS AT ISLAND |
| S/M: | 6.0 | 6.0 | |
| PROBABILITY: | 185 | 182 | |
| OPERATING RATE 2: | 94.93 | 85.23 | ****: RATIO OF THE NUMBER OF GIVEAWAY BALLS TO THE NUMBER OF LENT BALLS AT TABLE |

*Fig. 21A*

--- REPORT OF EACH ISLAND ---

| | NUMBER OF INCOMING BALLS | NUMBER OF OUTGOING BALLS | ** | RATE OF OUTGOING BALLS | *** | NUMBER OF TIMES OF SPECIAL PRIZE | G VALUE | S/M | PROBABILITY | OPERATING RATE 2 |
|---|---|---|---|---|---|---|---|---|---|---|
| S3 | 1878456 | 2126920 | −248464 | 113.23 | 123.61 | 21 | 42.66 | 6.1 | 177 | 94.95 |
| S4 | 1862885 | 1994719 | −131834 | 107.08 | 112.35 | 19 | 41.33 | 5.9 | 186 | 95.03 |
| S5 | 1877697 | 2071425 | −193728 | 110.32 | 118.60 | 20 | 43.24 | 6.2 | 194 | 95.16 |
| Z4 | 1801980 | 1942594 | −148614 | 107.80 | 113.63 | 18 | 41.23 | 5.9 | 186 | 85.01 |
| S1 | 1879157 | 2069825 | −190668 | 110.15 | 118.00 | 20 | 42.06 | 6.0 | 182 | 94.69 |

--- REPORT OF EACH TABLE ---

| | NUMBER OF INCOMING BALLS | NUMBER OF OUTGOING BALLS | ** | RATE OF OUTGOING BALLS | **** | NUMBER OF TIMES OF SPECIAL PRIZE | ***** | G VALUE | S/M | PROBABILITY | OPERATING RATE 1 | OPERATING RATE 2 |
|---|---|---|---|---|---|---|---|---|---|---|---|---|
| P#Z4_U5 | 61999 | 52699 | 9300 | 85.00 | 72.65 | 11 | 0 | 45.00 | 6.4 | 274 | 79.49 | 89.22 |
| P#Z4_U4 | 61558 | 70665 | −9107 | 114.79 | 125.74 | 20 | 0 | 40.77 | 5.6 | 159 | 78.92 | 85.38 |
| P#Z4_U3 | 59853 | 68454 | −8601 | 114.37 | 125.02 | 19 | 0 | 42.25 | 6.0 | 172 | 76.73 | 85.57 |
| P#Z4_U2 | 58638 | 66680 | −8042 | 113.71 | 122.50 | 20 | 0 | 35.72 | 5.1 | 133 | 75.18 | 85.51 |
| P#Z4_U1 | 58976 | 53417 | 5559 | 90.57 | 84.98 | 14 | 0 | 36.25 | 5.2 | 202 | 75.61 | 86.61 |
| P#Z3_L15 | 58978 | 65101 | −6123 | 110.38 | 117.81 | 18 | 0 | 40.58 | 5.8 | 174 | 75.61 | 87.07 |
| P#Z3_L14 | 58552 | 57558 | 994 | 98.30 | 96.94 | 14 | 0 | 48.84 | 6.3 | 233 | 75.07 | 85.35 |
| P#Z3_L13 | 59809 | 63661 | −3852 | 106.44 | 111.25 | 17 | 0 | 41.46 | 5.9 | 183 | 76.68 | 82.66 |
| P#Z3_L12 | 59544 | 81602 | −22058 | 137.04 | 167.61 | 25 | 0 | 42.40 | 6.1 | 112 | 76.34 | 81.13 |

***** (NUMBER OF TIMES OF PROBABILITY FLUCTUATION

*Fig. 21B*

SIMULATION SYSTEM FOR PLACE OF AMUSEMENT

TECHNICAL FIELD

The present invention relates to a simulation system. More specifically, this invention relates to a simulation system for an amusement arcade which generates a dynamic model of the amusement arcade having pinball machines, slot machines, other types of game machines.

BACKGROUND ART

It is known that, in an amusement arcade (parlor) having pinball machines, slot machines, etc., the structure of the amusement arcade, such as a position of the doorway, the problem of how many play machines such as pinball machines, slot machines, etc. are to be provided or how they are to be positioned, or the problem of how to position money changers, counters, etc., have a big influence on customer turnover, and consequently have a big influence on the management of the amusement arcade.

Up to now, such a structure of the amusement arcade or such a positioning of the play machines etc. have been decided on the basis of the experience or the like of a designer or a manager of the amusement arcade. That is to say, they have been decided on the basis of the past macro data such as the experience of the designer or the manager of the amusement arcade, and so it was impossible to know how the new structure of the amusement arcade or the new positioning of the play machines would exert an influence on the opinion of players.

Also at the gaming center which contains medal dispensing machines, in which players gain points by getting medals, or TV games, in which players gain points by fighting with enemies on the TV screens, the flow of customers and the positioning of the play machines or the money changers are problems of great interest concerning the management of the amusement arcade.

An object of the present invention is to provide a simulation system for an amusement arcade, which generates a dynamic model relating to the amusement arcade and can inspect operating conditions of play machines, a flow of players and the like.

DISCLOSURE OF THE INVENTION

The object of the present invention can be achieved by a simulation system for an amusement arcade comprising, a parameter setting means having a play machine setting means for setting a parameter which defines a structure of play machines constituting the amusement arcade and a player setting means for setting a parameter which defines properties of players who use the play machines, a simulation executing means for executing simulation of the amusement arcade for each unit time on the basis of the parameters set by the parameter setting means, a resultant data generating means for generating resultant data indicative of a result of simulation on the basis of the data obtained by the simulation executed by the simulation executing means for a predetermined unit time, and a display means for indicating a picture corresponding to the resultant data.

According to the present invention, the simulation for the amusement arcade is executed for each unit time on the basis of the parameters set by the parameter setting means and the resultant data indicating the result is obtained, and so operators can obtain the result of the simulation based on the models of the amusement arcade set by themselves and can inspect them.

The preferable mode of the present invention further comprises picture data generating means which generates picture data based on the parameter set by said parameter setting means and also generates picture data during the execution of the simulation on the basis of the picture data and the data obtained for each unit time by the simulation executing means.

According to this mode, pictures during the execution of the simulation can be obtained for each unit time, and so the operator can recognize the operating condition of the play machine based on the model of the amusement arcade set by himself/herself.

In a further preferable mode of this invention, the parameter setting means further comprises a peripheral machine setting means which defines the structure of the peripheral machines disposed in the amusement arcade.

According to a further preferable mode of the present invention, the structure of peripheral machine can be defined, which enables the structure of the amusement arcade to be defined more specifically.

In a further preferable mode of the present invention, the peripheral machine setting means is composed so as to define the structure of counters which count play media to be used in the play machines and of money changers which change money.

In a further preferable mode of the present invention, the parameter setting means further comprises a move route setting means for setting the move route of players between the play machines or between the play machines and the peripheral machines.

According to a further preferable mode of the present invention, the move route or the path of flow of the player can be set, and so the operator can recognize the movement of the player during the execution of the simulation.

In a further preferable mode of the present invention, the player setting means is composed so as to set the operating rate data indicating the rate of use of the play machines by the players, the player time data indicating a distribution of playing times of the players, the maximum money amount data indicating the amount of money which players can spend, and the buying unit data indicating the number of play media which players buy at a time.

In a further preferable mode of the present invention, the player setting means is composed so as to set automatically, in compliance with the condition of the amusement arcade, the operating rate data, the player time data, the maximum money amount data, and the buying unit data.

In a further preferable mode of the present invention, the play machine setting means is composed so as to set the type of the play machine, and the simulation executing means is composed so as to determine the winning interval for the play machine during the simulation on the basis of the set type of play machine.

In another mode of the present invention, the simulation is realized by judging the state of play machines in each unit time, and by executing at least one of counting the number of the play media and a change of state, in accordance with the judged state. The state includes a state in which the play machine doesn't operate, a state in which the play machine operates, and a state in which the play machine is winning.

Further, pinball machines, slot machines, game machines or the like are included as play machines.

BRIEF DESCRIPTION OF THE DRAWINGS

FIG. 21 is an illustration of the example of the picture based on the data generated by a result analyzing unit referring to the first embodiment.

BEST MODE FOR CARRYING OUT THE INVENTION

The following is a detailed explanation on an embodiment of the present invention based on the attached drawings.

Figure 1:
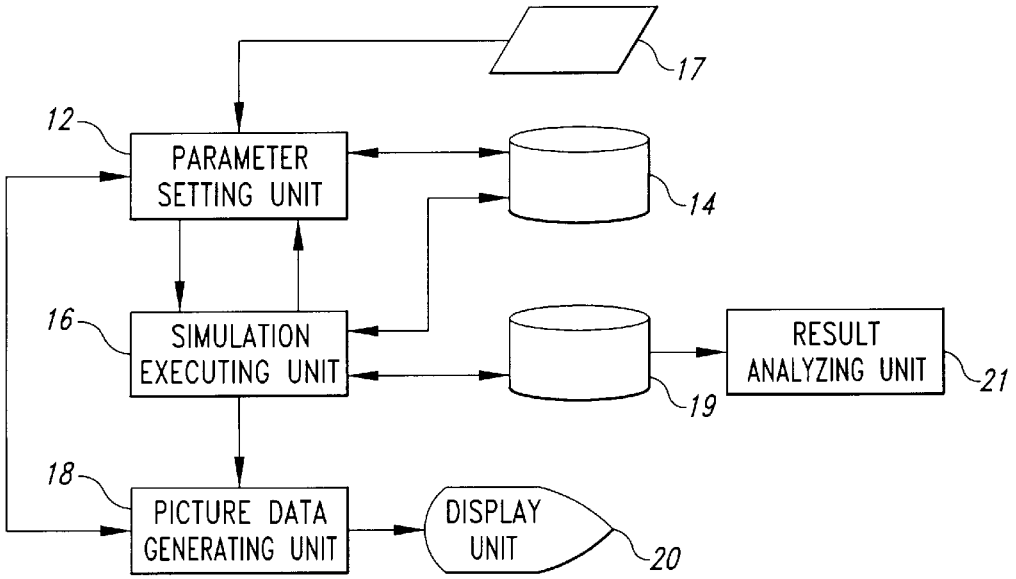
FIG. 1 is a block diagram showing the structure of a simulation system for an amusement arcade referring to an embodiment of the invention.

FIG. 1 is a block diagram indicating the structure of a simulation system for an amusement arcade relating to the embodiment of this invention. In a first embodiment, the amusement arcade means the so-called pinball (pachinko-ball game) parlor. As shown in FIG. 1, the simulation system for the amusement arcade 10 comprises a parameter setting unit 12 for setting various parameters for defining the various structural elements which constitute the amusement arcade, a parameter memory unit 14 for memorizing these parameters, a simulation executing unit 16 for executing the simulation on the basis of the set structure parameter, an input apparatus 17 composed of a keyboard and a mouse, a picture data generating unit 18 for generating picture data based on the data obtained by the simulation executing unit 16, a simulation result memory unit 19 for memorizing the data obtained by the simulation executing unit 16, a display unit 20 for indicating pictures corresponding to the generated picture data, and a result analyzing unit 21 for generating the data indicating the simulation result on the basis of the data memorized in the simulation result memory unit 19.

Figure 2:
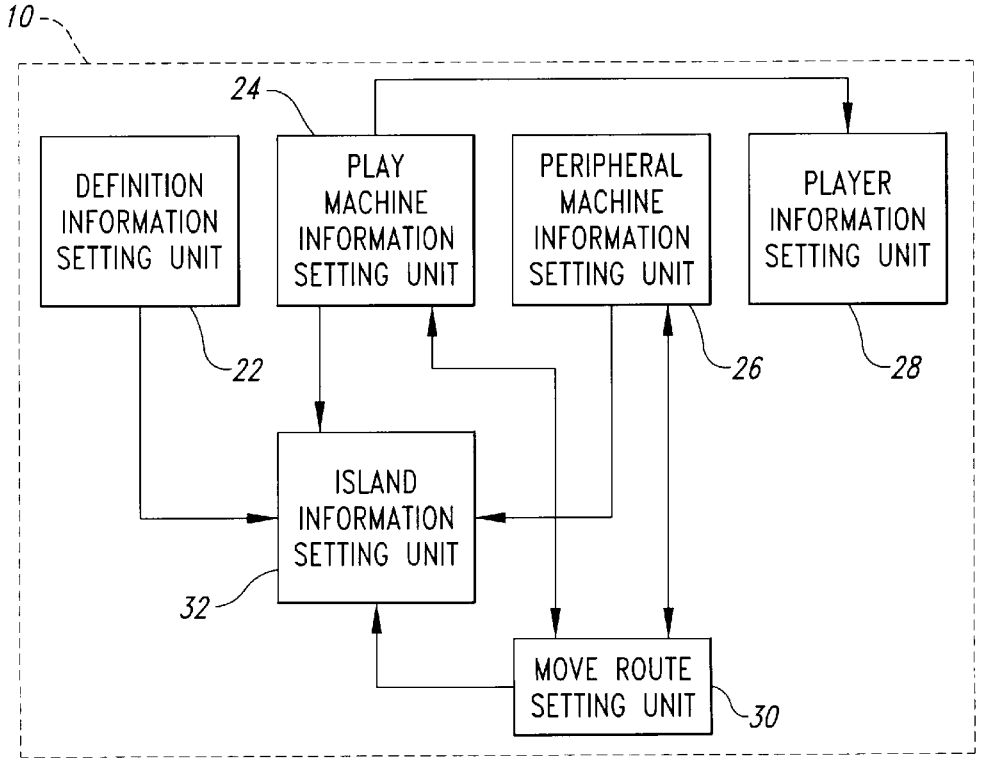
FIG. 2 is a block diagram showing the structure of a parameter setting unit in more detail.

FIG. 2 is a block diagram indicating the more detailed structure of the parameter setting unit 12. Here, in the first embodiment, the various structural elements of the amusement arcade defined by the parameter setting unit 12, that is to say, facilities such as play machines, peripheral machines and the like, or players, are referred to as modules. The parameter setting unit 12 sets diverse parameters for constituting such modules.

As shown in FIG. 2, the parameter setting unit 12 comprises a definition information setting unit 22 for setting the information of the definition for defining the whole of the simulation, a play machine information setting unit 24 for setting the information of the play machine for defining the structure of play machine module such as a pinball machine, a peripheral machine information setting unit 26 for setting the information of the peripheral machine for defining the structure of a peripheral machine module, such as a money changer module, which is other than play machine module disposed in the amusement arcade, a player information setting unit 28 for setting the information of the player relating to the player module which enters the amusement arcade and utilizes the play machine module or the like, an island information setting unit 30 for setting the information for deciding the location of the island module, and a move route setting unit 32 for deciding the move route of the player module.

The definition information setting unit 22 is composed so as to set the simulation time data relating to the simulation time and the exit data for deciding the exit of the amusement arcade.

The play machine information setting unit 24 is composed so as to set play machine name data indicating the name of the play machine module, play machine type data indicating the type of the play machine module, belonging island name data indicating the name of the island module to which said play machine module belongs, out of the island modules having a plurality of play machine modules disposed in a predetermined arrangement.

Further, the peripheral machine information setting unit 26 is composed so as to set counter name data indicating the name of the counter module for counting the play media which player module has gained, counter processing time data indicating the time required for counting the play media in said counter module, or the like.

The player information setting unit 28 is composed so as to set play time data indicating a distribution of play time of the player module, maximum expense data indicating a distribution of the amount of money which a player module can spend, buying unit data indicating a distribution of play media unit which the player module buys at a time, or the like.

Next, the information set at the parameter setting unit 12 will be explained in more detail.

In the first embodiment, the play machine module and the island module which can be set by the parameter setting unit 12 are supposed to adopt respectively one of the two restoration methods of play media. In the first embodiment, one of the methods is called "independent island restoration method" and the other is called "overall restoration method".

Firstly, "independent island restoration method" will be explained. Under the structure of the independent island restoration method, a counter for counting play media is located at the play machine which belongs to an island consisting of a plurality of play machines disposed in a predetermined arrangement, and the play media discharged from the play machine and the play media given to the counter disposed in the island are restored in the play machines or the like belonging to the island. On the other hand, under the structure of overall restoration method, play media discharged from all play machines in the amusement arcade and the play media given to all counters disposed in the amusement arcade are restored to all play machines.

How the play media are to be supplied in the play machines is such an important problem in designing the amusement arcade, that the play machine module is applicable to selecting one of the two methods, in the first embodiment. In the first embodiment, it is also possible to locate, in one amusement arcade, both the island module based on the independent island restoration method and the other one based on the overall restoration method. Thus, as mentioned later, the case which adopts the independent island restoration method and the other case which adopts the overall restoration method can be compared.

Figure 3:
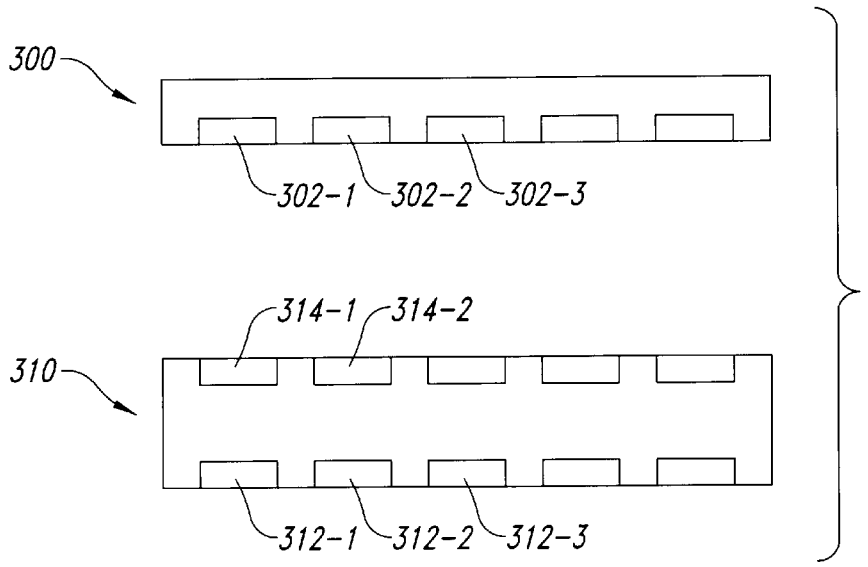
FIG. 3 is a drawing for illustrating islands of the first embodiment.

Here, "island" determined at an island setting unit 30 will be explained. In the first embodiment, "island" is a construction of a plurality of play machines disposed in a predetermined arrangement and also comprises the counter and the money changer used in relation to the play machines. For example, as shown with the reference number 300 of FIG. 3, the island which comprises a row of play machines 302-1, 302-2 . . . arranged in the lateral direction with the predetermined number is called "one side island", while as shown with the reference number 310, the island which comprises two rows of play machines 312-1, 312-2, . . . , 314-1, 314-2, . . . arranged in the lateral direction is called "whole island". The position possibility play machine data which indicate that which type of play machine module is to be located in the island module corresponding to them, or as to the island name data which indicate the name of the island module, will be described later.

The play machine type data include the data indicating the type of play machine module, for example, in the first embodiment, so-called "fever (=special winning) type table (first type pinball machine)", "probability fluctuation type table", "rights type table (third type pinball machine), wherein, if play goes through a specific process after the special winning, it can obtain the rights whereby the next special winning is prone to occur", or "wing type table (second type pinball machine), wherein an entrance of a ball into a specific hole (V zone) of the center of machine makes a special winning". In compliance with the play machine type data, the winning interval of the play machine module during the execution of simulation, the number of play media discharged from the play machine module (which is called "the number of outgoing balls") or the like are determined.

As to the belonging island name data, out of the names corresponding to the island name data which will be described later, the data corresponding to the name of island module to which play machine module belongs is applied.

The information set by the play machine information setting unit 24 includes the first use counter data for specifying the first counter module used for the count of play media by the player module which utilizes the play machine module during the simulation, the second use counter data for specifying the second counter module used for the count when the player module can not use the first counter module, the first use money changer data for specifying the first money changer module used by the player for the money change, and the second use money changer data for specifying the second money changer module used for money change when the player can not use the first money changer module. These data include, respectively, the counter move time data or the money changer move time data, indicating the time of movement from play machine module to counter module or to money changer module.

Further, the data set at the play machine information setting unit 24 includes use bank note data, indicating if bank notes are usable, and also indicating, if they are usable, which kind of bank notes (for example, 1000 yen bank note, 5000 yen bank note, etc.) are usable, output details degree data, which will be described later, indicating the degree of details of the output after the execution of the simulation, and priority data indicating the degree of popularity of the play machine module. In accordance with the value of this priority data in a predetermined case, as described later, the player module selects the play machine module. In the first embodiment, the value of the priority data can be one of the five, and this value corresponds to the numerical value of from 1 to 100. Also, the sum total of the quota is supposed to be 100. Thus, in a predetermined case, the player module selects the predetermined play machine module with the probability based on the numerical value corresponding to the value of priority data.

Figure 4:
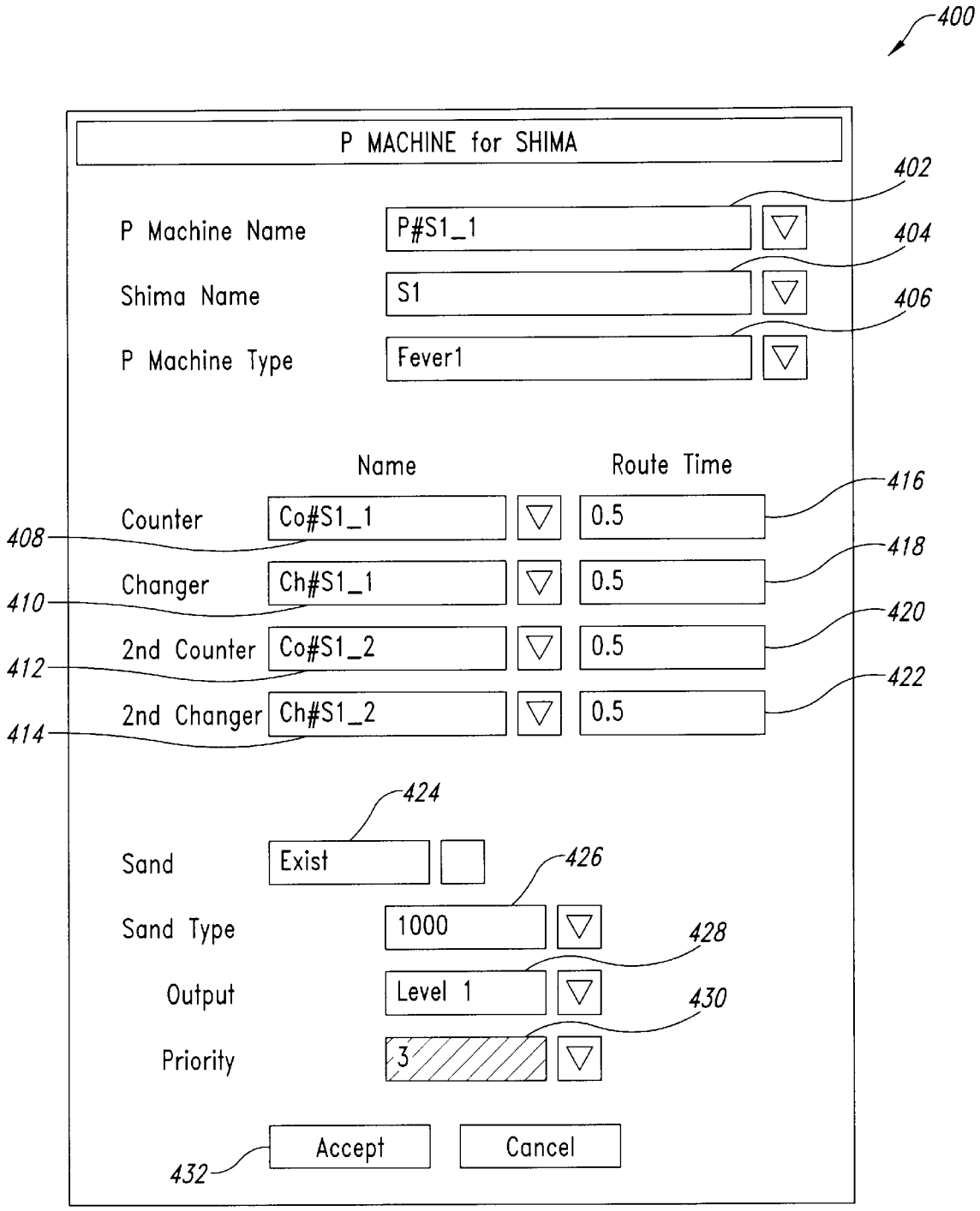
FIG. 4 is an illustration of a picture on a screen of a display unit indicated by the start of a play machine information setting unit of a parameter setting unit relating to the first embodiment.

FIG. 4 is an illustration of the picture which is indicated on the screen of the display unit 20, after the play machine information setting unit 24 of the parameter setting unit 12 is started and predetermined information is given from the parameter setting unit 12 to the picture data generating unit 18, in accordance with the picture data generated on the basis of said information. When the operator inputs some information by means of the input apparatus 17, the characters, figures, etc. corresponding to the inputted information are indicated in the part 402, 404, etc. in the screen 400. Here, the characters or the like indicated in the parts 402 correspond to the play machine data, the characters or the like indicated in the part 404 correspond to the belonging island name data, and the characters or the like indicated in the part 406 correspond to the play machine type data.

The characters or the like indicated in the parts 408, 410, 412, 414 correspond to the first use counter data, the first use money changer data, the second use counter data, and the second use money changer data, respectively, and the figures indicated in the parts 416, 418, 420, 422 located next to these parts from 408 to 414 correspond to the move time data which belong to these data, respectively.

Further, the characters or the like indicated in the parts 424, 426 correspond to the use bank note data, and the characters or the like indicated in the parts 428, 430 correspond to output details degree data and the priority data respectively.

When the operator inputs some information by means of the input apparatus 17, the given characters, figures, etc. are indicated in the parts from 402 to 430 in the screen 400 of the display unit 20. When the operator designates the part 432 of the screen 400 by means of the input apparatus 17 after the predetermined information is given in the parts from 402 to 430, the data corresponding to the characters, figures, etc. given to the parts from 420 to 430 are stored in a predetermined area of the parameter memory unit 14.

Next, the information which is set at the peripheral machine information setting unit 26 will be explained.

In the first embodiment, the peripheral machine module includes the counter module and the money changer module. In the independent island restoration method, the peripheral machines further include a just counter module. In the first embodiment, the just counter comprises functions of both a counter and a money changer.

The information relating to the counter module set by the peripheral machine information setting unit 26 includes, other than the above mentioned, a counter waiting queue data indicating the maximum number of player modules waiting at the counter module, and the counter money changer move time data indicating the move time from the counter module to the money changer module.

The peripheral machine information setting unit 26 sets money changer name data indicating the name of the money changer module by which players change money, money changer processing time data indicating the time required for the change at the money changer module, and money changer waiting queue data indicating the maximum number of players who are waiting for changing at the money change module. Further, in the independent island restoration method, the peripheral machine information setting unit 26 sets just counter name data indicating the name of the just counter module, just counter count processing time data indicating the time which the just counter module requires for counting the play media, just counter money change processing time data indicating the time which the just counter module requires for money change, and just counter waiting queue data indicating the maximum number of player modules waiting for counting or changing at the just counter module.

Figure 5:
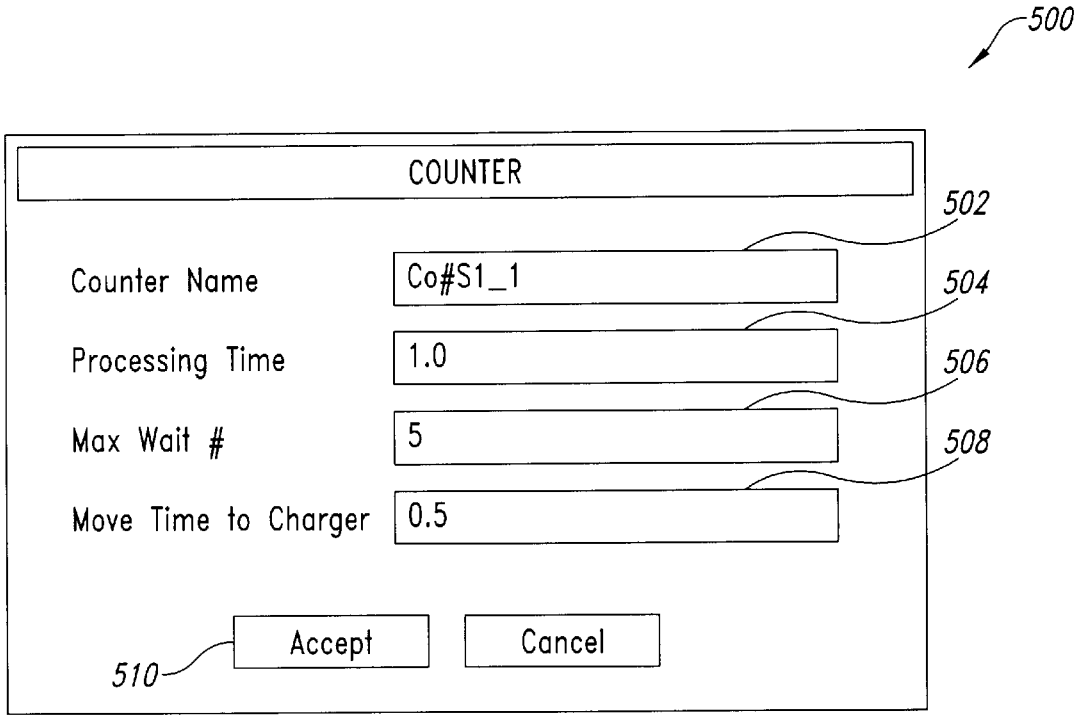
FIG. 5 is an illustration of a picture on the screen of the display unit indicated by the start of a peripheral machine information setting unit of the parameter setting unit referring to the first embodiment.
Figure 6:
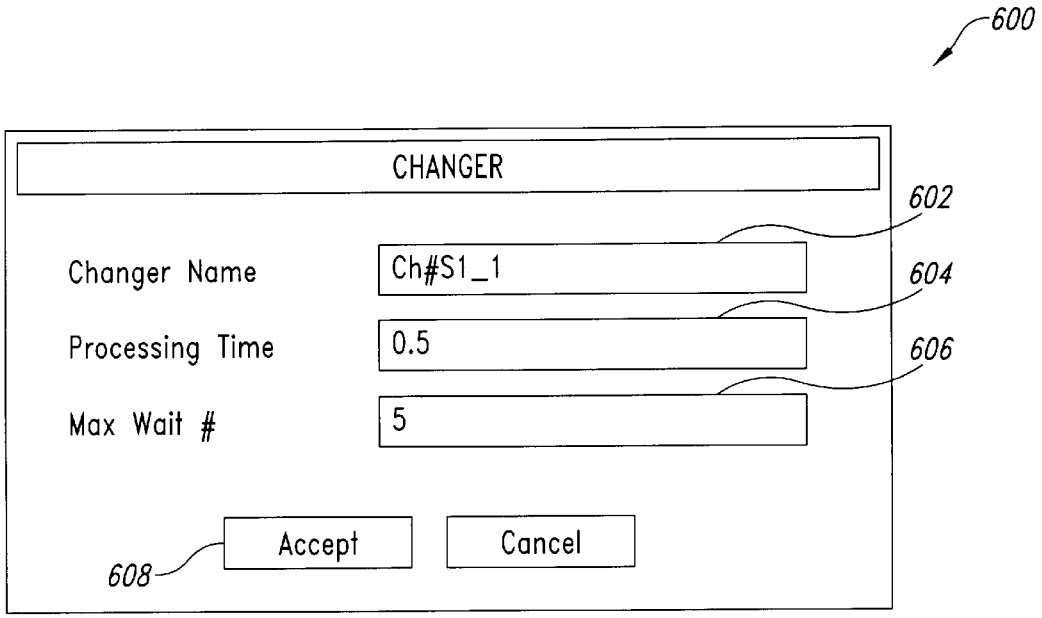
FIG. 6 is an illustration of a picture on the screen of the display unit indicated by the start of the peripheral machine information setting unit of the parameter setting unit referring to the first embodiment.
Figure 7:
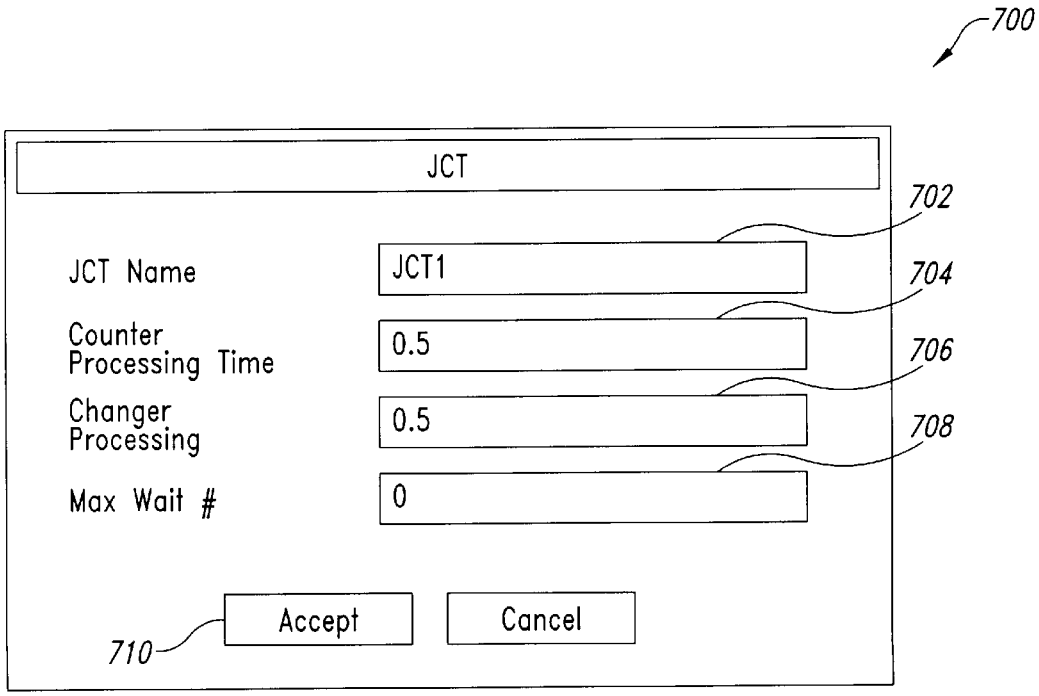
FIG. 7 is an illustration of a picture on the screen of the display unit indicated by the start of the peripheral machine information setting unit of the parameter setting unit referring to the first embodiment.

FIGS. 5, 6 and 7 are the illustrations of the pictures which are indicated on the screens of the display unit 20, after the peripheral machine information setting unit 26 of the parameter setting unit 12 is started and predetermined information is given from the parameter setting unit 12 to the picture data generating unit 18, in accordance with the picture data generated on the basis of the information. As shown in FIG. 5, on the screen 500 of the display unit 20, parts 502, 504, 506, and 508 are disposed. When the operator inputs some information by means of input apparatus 17, characters, figures or the like, corresponding to the inputted information, are indicated in the respective parts from 502 to 508. The characters etc. indicated in the part 502 correspond to the counter name data, the figures indicated in the part 504 correspond to the counter processing time data, the figures indicated in the part 506 correspond to the counter waiting queue data and the figures indicated in the part 508 correspond to the counter money changer move time data.

The characters etc. indicated in the part 602 of the screen 600 in FIG. 6 correspond to the money changer name data, the figures indicated in the part 604 correspond to the money changer processing time data, and the figures indicated in the part 606 correspond to the money changer waiting queue data. Further, the characters etc. indicated in the part 702 of the screen 700 in FIG. 7 correspond to the just counter name data, the figures indicated in the part 704 correspond to the just counter count processing time data, the figures indicated in the part 706 correspond to the just counter money change processing time data, and the figures indicated in the part 708 correspond to the just counter waiting queue data. The pictures from 500 to 700 indicated in FIGS. 5, 6, and 7 can be switched by inputting a predetermined information by means of input apparatus 17 by the operator. When the operator inputs some information by means of input apparatus 17, given characters, figures, etc. are indicated in the parts from 502 to 710 of the screens from 500 to 700 of the display unit 20. When the operator designates, by means of the input apparatus 17, parts 510, 608, and 710 of the screens 500, 600 and 700 respectively after predetermined information is given in the parts from 502 to 710, data corresponding to the characters, figures, etc. given to the parts from 502 to 508, parts from 602 to 606, and parts from 702 to 708 are stored in a predetermined area of the parameter memory unit 14 respectively.

Next, the information set by the player information setting unit 28 will be further explained. In the player information setting unit 28, information includes, in addition to the described data, parameter automatic setting selection data for automatically setting the properties of the player module in accordance with the condition of the amusement arcade, or for selecting whether the properties of player module are inputted respectively. When the parameter automatic setting selection data designate input of the respective properties of player module, operating rate data indicating the operating rate of the play machine module for each predetermined time zone, play machine selection data for deciding the law in compliance with which the player module selects the play machine module, above described play time data, above described maximum expense data, and above described buying unit data can be set by the operator respectively.

On the other hand, when the parameter automatic setting selection data designate to set the properties of player module automatically, further, type selection data indicating whether the amusement arcade is located in the suburbs (that is, whether it is the so-called suburban type), whether it is disposed near a railroad station or the like (that is, whether it is the so-called station adjacent type), or whether it has just been refurbished can be set by the player information setting unit 28. Then, corresponding to these set data, the operating rate data, the play machine selection data, the play time data, the maximum expense data and the buying unit data are set automatically.

Further, as data set by the player information setting unit 28, entrance-play machine move time data indicating a distribution of move time from the entrance of the amusement arcade to the play machine module, and money change unit data indicating a distribution of a sum of money changed by player module at a time are included.

In the first embodiment, operating rate data indicate an operating rate of every hour of the player table. And the play machine selection data indicate whether the player module selects the play machine module at random, or whether it selects the play machine module at the probability based on above described priority data.

Figure 8:
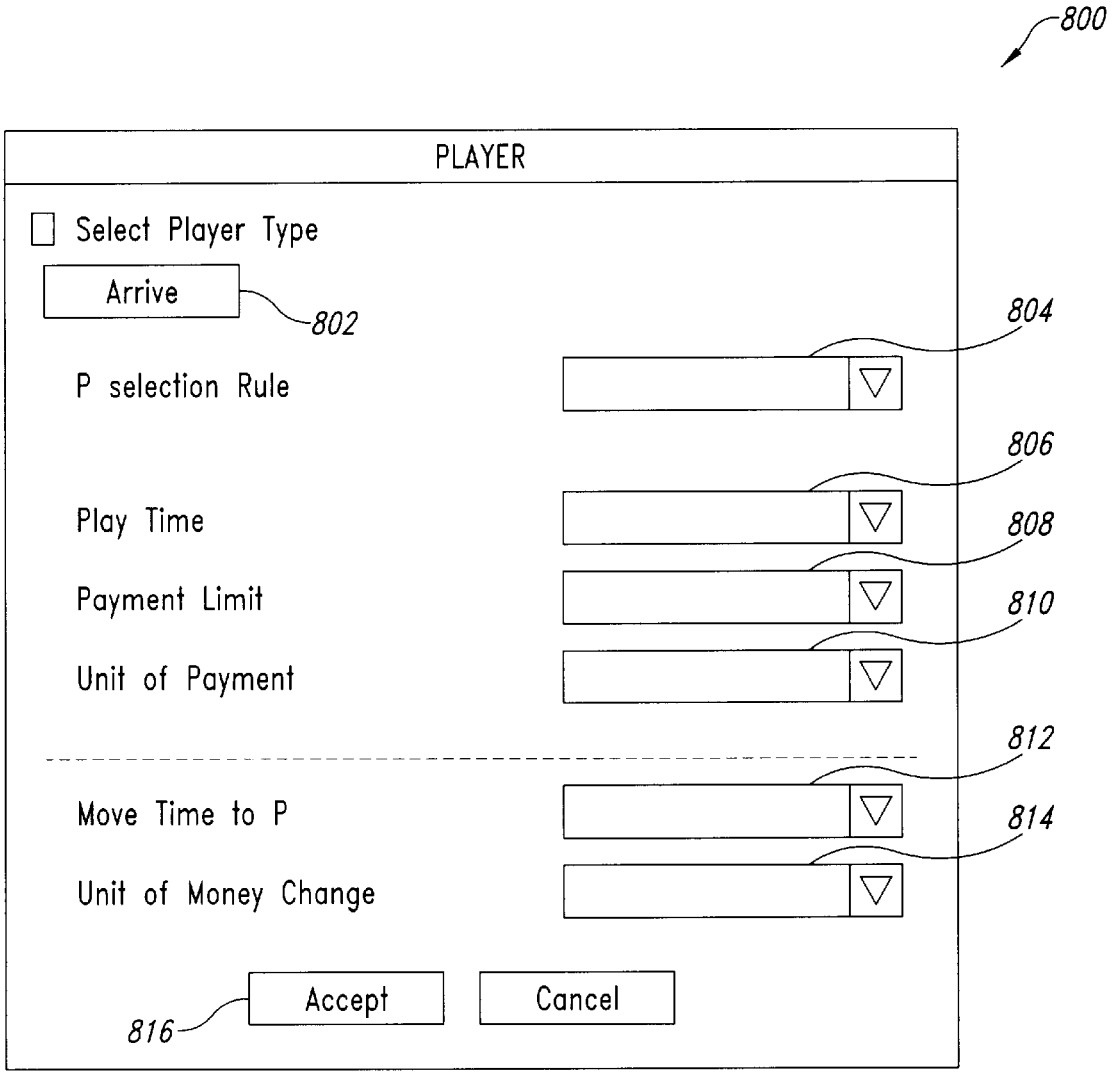
FIG. 8 is an illustration of a picture on the screen of the display unit indicated by the start of a player information setting unit of the parameter setting unit referring to the first embodiment.

FIG. 8 is an illustration of a picture which is indicated on the screen of the display unit 20, after the player information setting unit 28 of the parameter setting unit 12 is started and the predetermined information is given from the parameter setting unit 12 to the picture data generating unit 18, in accordance with the picture data generated on the basis of the information. As shown in FIG. 8, on the screen 800 of the display unit 20, parts 802, 804, 806, 808, 810, 812, and 814 are disposed. In the part 802, characters corresponding to the parameter automatic setting data are indicated. As an example shown in FIG. 8, in the part 802, characters which designate to set the properties of player module respectively are indicated. Characters etc. indicated in the part 804 correspond to the play machine selection data, characters etc. indicated in the part 806 correspond to the play time data, characters etc. indicated in the part 808 correspond to the maximum expense data, and characters etc. indicated in the part 810 correspond to the buying unit data, respectively are indicated.

Characters etc. corresponding to part 812 correspond to the entrance-play machine move time data and characters etc. corresponding to part 814 correspond to the money change unit data, respectively. Thus, when the parameter setting selection data designating to set the respective properties of player module are selected, the operator can set the operating rate data, the play machine selection data, the play time data, the maximum expense data and the buying unit data, by inputting predetermined information by means of input apparatus 17.

Figure 9:
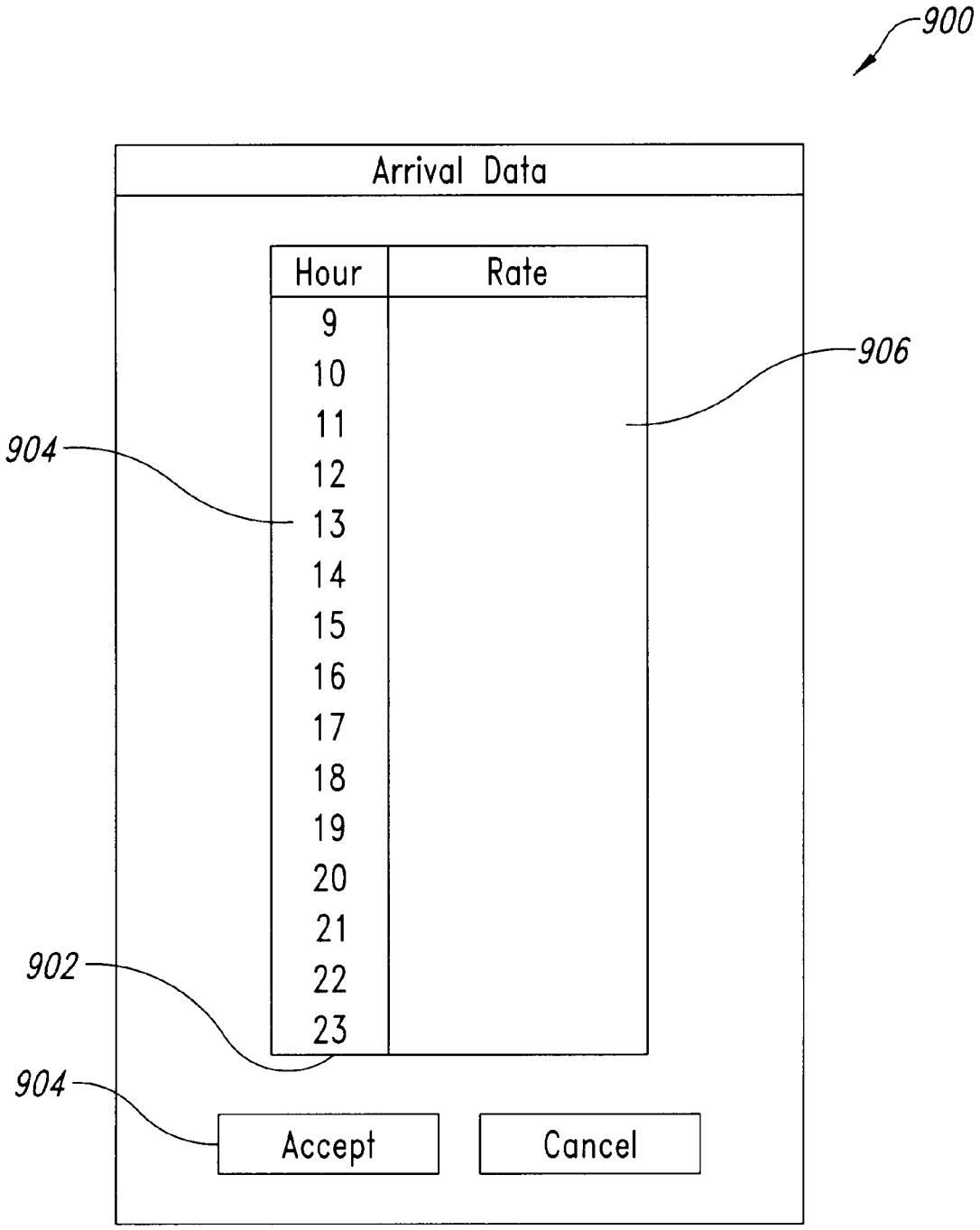
FIG. 9 is an illustration of a picture which is shown when one of the data, indicating that the types of player modules are to be set respectively, is selected as automatic parameter setting selection data.

Further, when the parameter automatic setting selection data designating to set respectively the types of player modules are selected by the operator, the picture indicated in FIG. 9 is generated by the input of predetermined information by the operator with the input apparatus 17. Thus, the operator can input the numerical value, in the part 906, indicating the operating rate of the play machine module for each time included in operating rate data, referring to the time indicated in the part 904. When the operator designates the parts 816 and 904 of the screens 800 and 900 respectively by means of the input apparatus 17 after predetermined information is given in the parts from 802 to 814 of the screen 800 of FIG. 8 and in the part 906 of the screen 900 of FIG. 9 by the operator, data corresponding to characters, figures, etc. given in the parts from 802 to 814 and in the part 906 are stored respectively in the predetermined area of the parameter memory unit 14.

Figure 10:
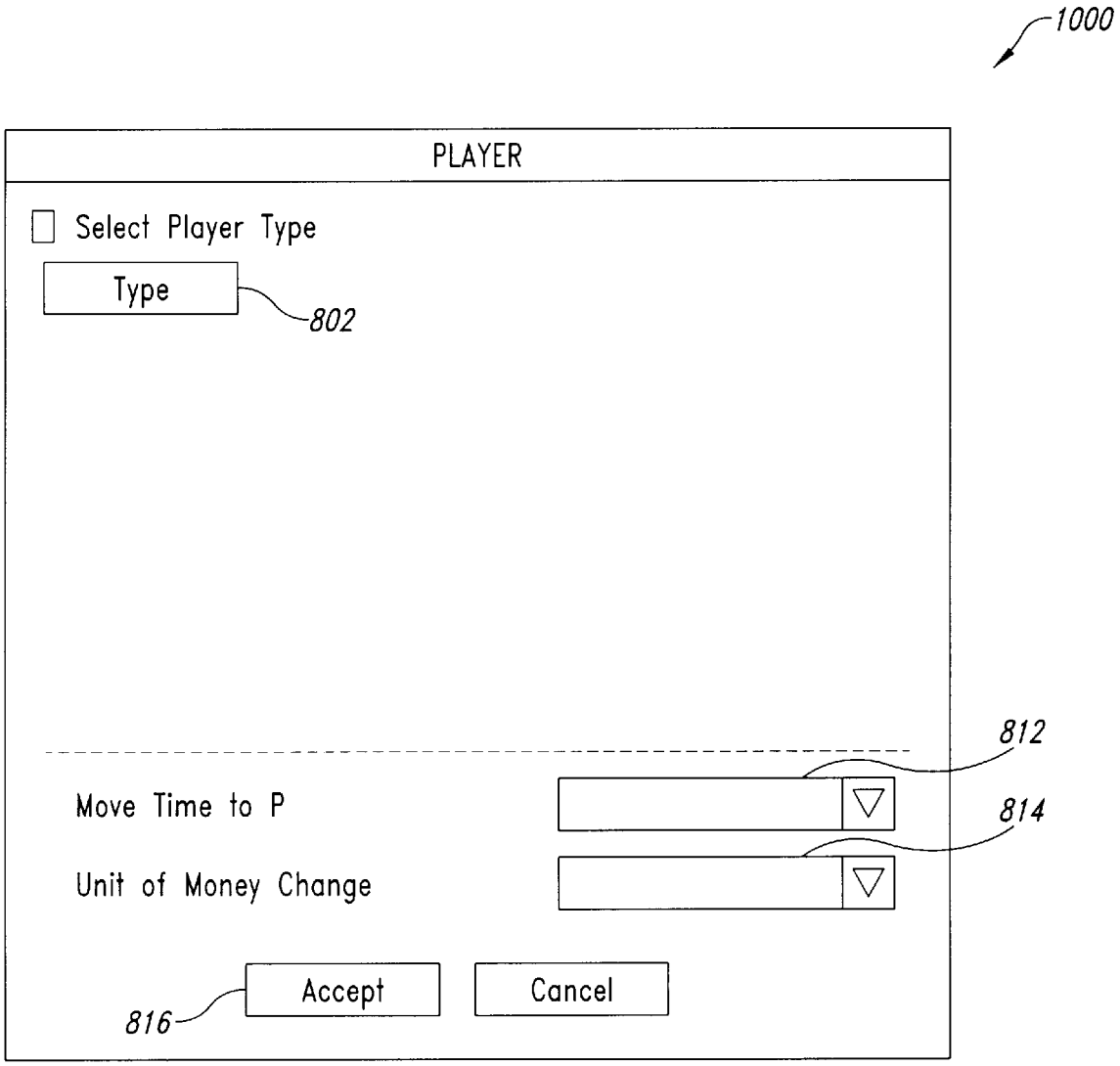
FIG. 10 is an illustration of a picture which is shown when one of the data, indicating that the properties of player module are to be set automatically, is selected as automatic parameter setting selection data.

On the other hand, when the parameter automatic setting selection data designating to set the properties of player module automatically are selected by the operator, the picture as indicated in FIG. 10 is given on the screen of display unit 20. As an example indicated in FIG. 10, in the part 802 of the screen 1000, characters designating to set the type of the player statistically are indicated. As the play machine selection data, the play time data, the maximum expense data and the buying unit data are generated automatically, and the parts from 804 to 810 indicated in FIG. 8, where corresponding characters etc. are indicated, are omitted. In this case, the operator can select the information corresponding to the type selection data by inputting predetermined information by means of the input apparatus 17.

Figure 11:
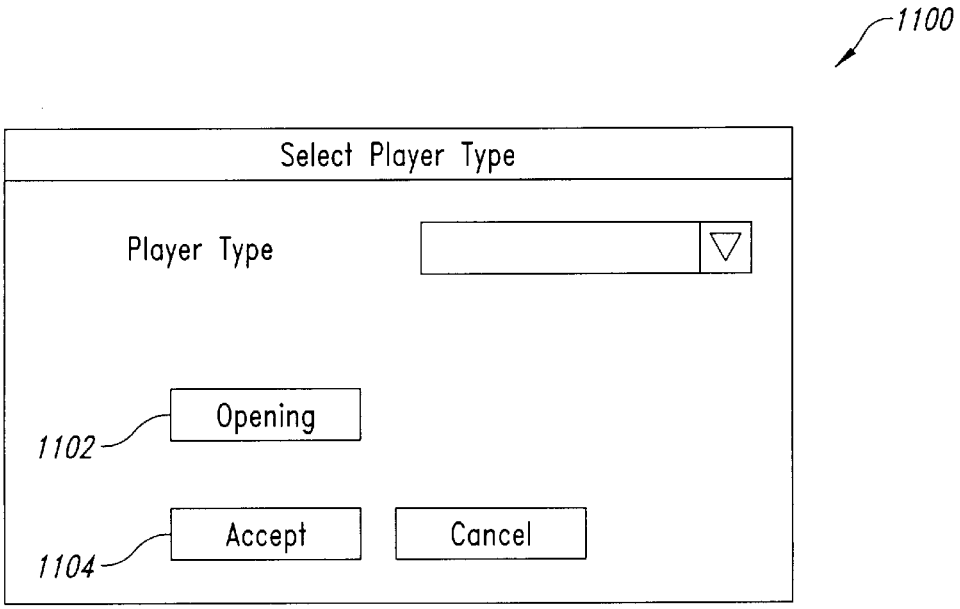
FIG. 11 is an illustration of a picture on the screen of the display unit for selecting the information corresponding to type selection data.
Figure 12:
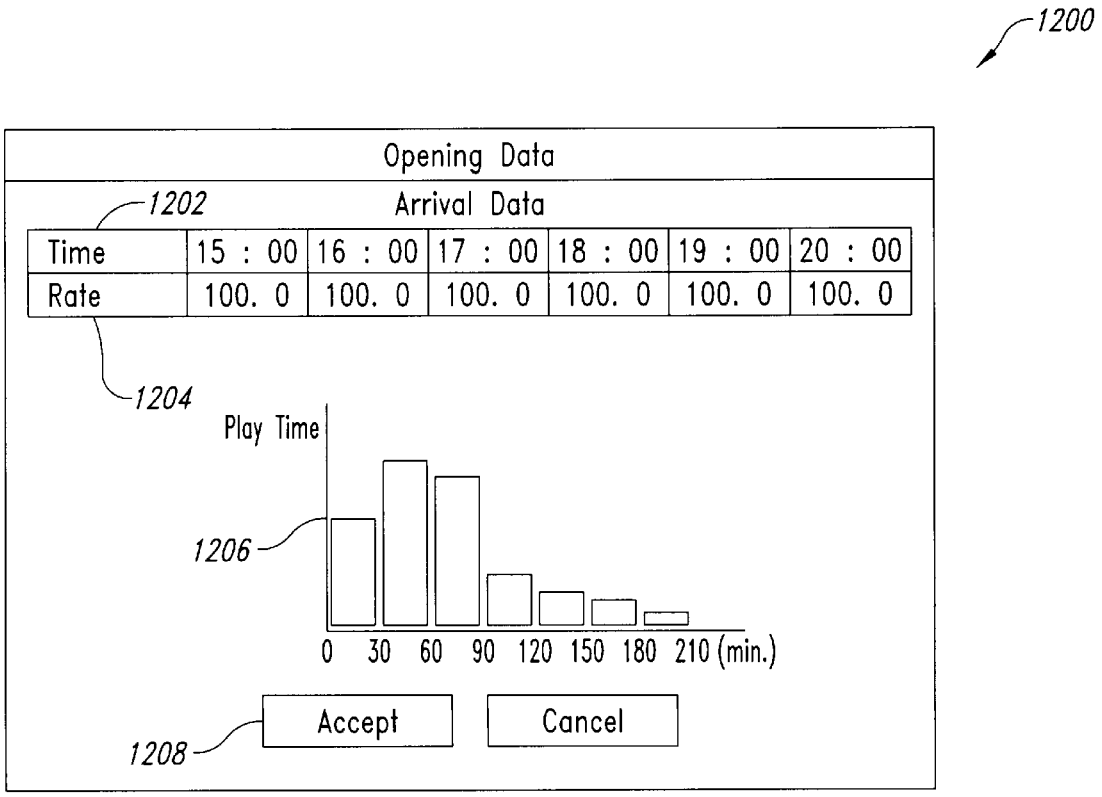
FIG. 12 is an illustration of a picture which is shown when an operator issues an order for referring to a value or the like corresponding to the data set automatically in accordance with type selection data.

FIG. 11 is an illustration of a picture on the screen of the display unit 20 in the case of selecting the information corresponding to the type selection data. As shown in FIG. 11, the type of the player selected by the operator is indicated in the part 1102 when the operator inputs predetermined information by means of the input apparatus 17. In the example of the illustration, characters indicating the time of refurbished opening is indicated. Further, the picture indicated as FIG. 12 can be obtained when the operator gives instructions for referring to the value etc. corresponding to the data set automatically in compliance with the type selection data. As shown in FIG. 12, if the type selection data indicate the time of refurbished opening, it can be recognized that each operating rate indicated in the part 1204 for each time indicated in the part 1202 is 100 percent. Also, with a bar chart indicated in the part 1206, the distribution of play time is indicated. The operating rate and the play time correspond to the operating rate data and the play time data respectively.

It is evident that, also when the type selection data are selected by the operator to be the so-called suburban type or to be the so-called station adjacent type, the picture like FIG. 12 can be obtained.

When the operator designates the parts 816 and 1104 on the screens 1000 and 1100 respectively by means of the input apparatus 17 after the predetermined information is given to the parts 802, 812, and 814 on the screen 1000 of FIG. 10 and the part 1102 on the screen 1100 of FIG. 11, the data relating to the given information are stored in the predetermined area of the parameter memory unit 14 respectively.

Next, the data set by the island setting unit 30 will be explained. In the island setting unit 30, the one side island module and whole island module based on the independent island restoration method, and the one side island module and whole island module based on the overall restoration method, can be set.

The island setting unit 30 sets, for example, the island name data indicating the name of the island module referring to the one side island module or whole island module based on the independent island restoration method, positioning possible play machine data indicating the type of the play machine which can be located in the island module, alternative counter data indicating the name of the second counter module that the player module uses when the counter module located in the island module is occupied, alternative counter move time data indicating the move time to the second counter module, alternative money changer data indicating the name of the second money changer module that player module uses when the money changer module disposed in the island module is occupied, and alternative money changer move time data indicating the move time to the second money changer module. The data which overlap the ones set by the above mentioned play machine setting unit 24 or the peripheral machine setting unit 26 can be also set. For example, this island information setting unit 30 can set the data relating to the counter module or the money changer module disposed in the island module based on the independent island restoration method.

Figure 13:
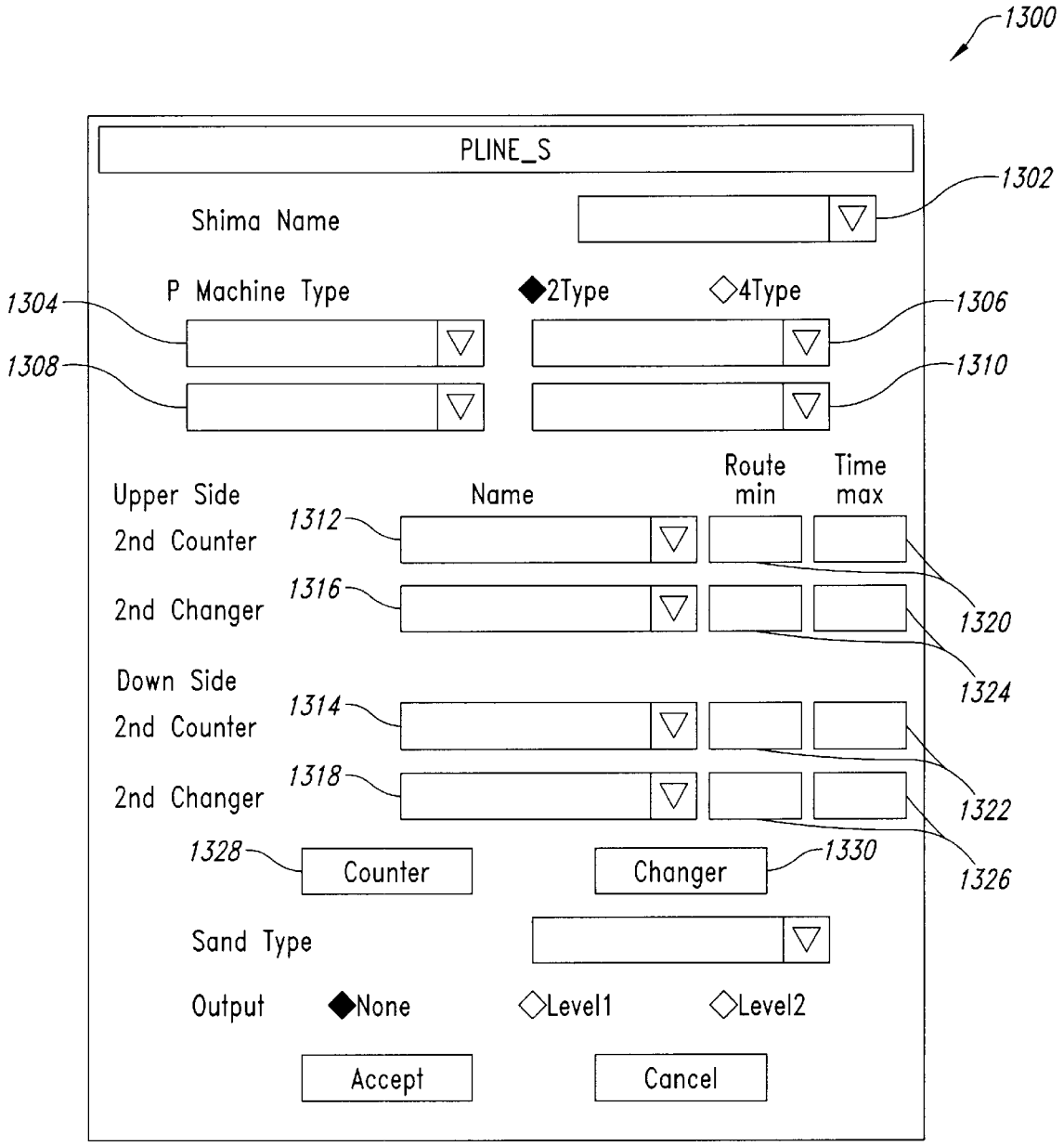
FIG. 13 is an illustration of a picture on the screen of the display unit indicated by the start of an island information setting unit of the parameter setting unit referring to the first embodiment.

FIG. 13 is an illustration of the picture which is indicated on the screen of the display unit 20, after the island information setting unit 30 of the parameter setting unit 12 is started and predetermined information is given from the parameter setting unit 12 to the picture data generating unit 18, in accordance with the picture data generated on the basis of the information. When the operator inputs some information by means of the input apparatus 17, characters, figures, etc. corresponding to the inputted information are indicated in the part 1302 etc. of the screen 1300.

For example, the characters etc. indicated in the part 1302 correspond to the island name data, the characters etc. indicated in the parts from 1304 to 1310 correspond to the positioning possible play machine data, the characters etc. indicated in the parts 1312 and 1314 correspond to the alternative counter data, the characters etc. indicated in the parts 1316 and 1318 correspond to the alternative money change data, and the parts from 1320 to 1326 correspond to the relevant move time data.

If the operator selects the parts 1328 or 1330 by means of the input apparatus 17, the pictures as shown in FIGS. 5 or 6 can be obtained.

It is almost the same also in the case of setting the one side island module or the whole island module based on the overall restoration method, but in this case, the counter module or the money changer module are not located in the island, and so the relevant data are not set.

Figure 14:
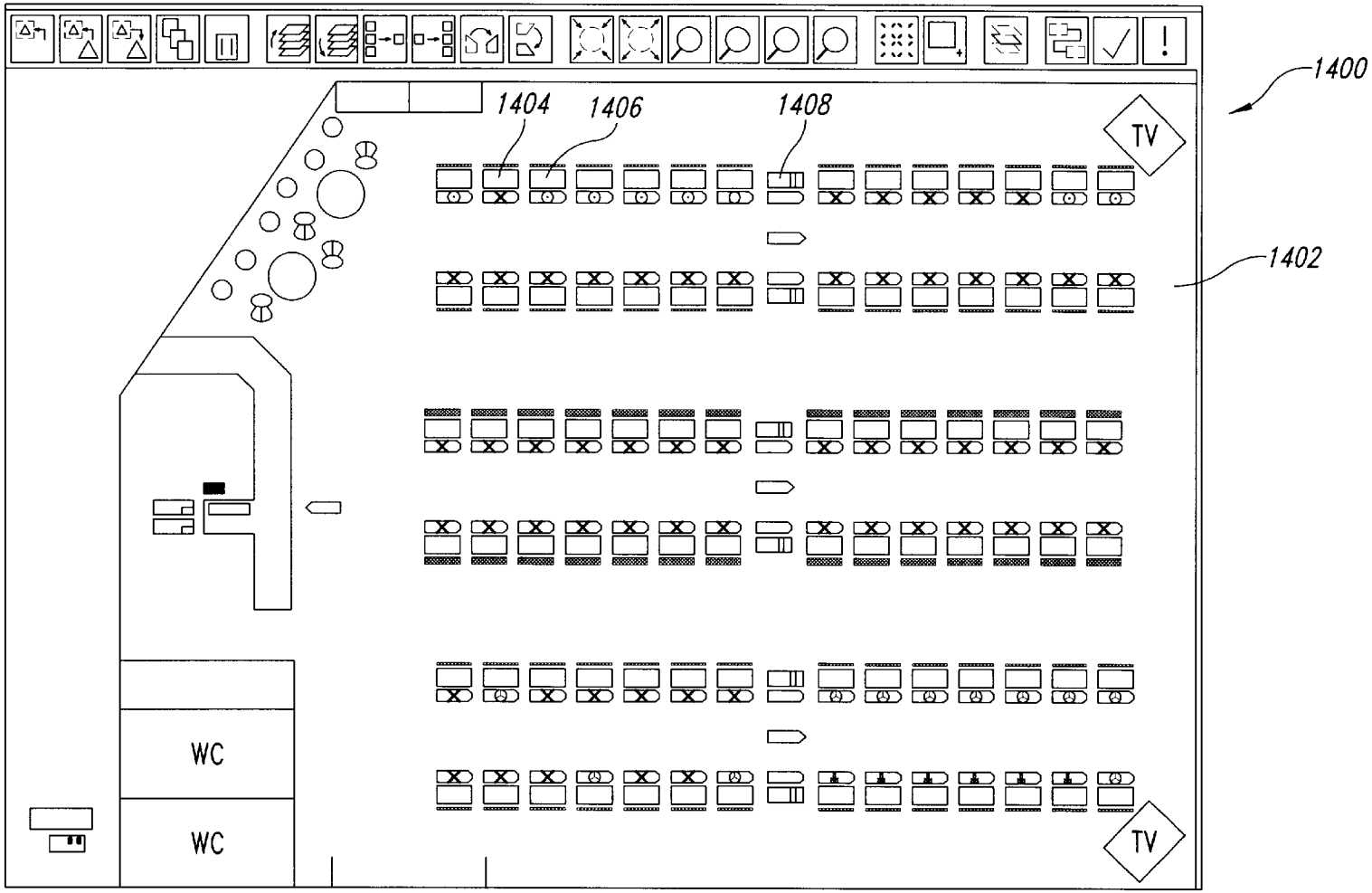
FIG. 14 is an illustration of a whole amusement arcade referring to the first embodiment.

Thus, when the operator gives instructions to indicate the whole of the amusement arcade after setting the necessary parameters relating to the machines and the players necessary for the amusement arcade, the predetermined information is given from the parameter setting unit 12 to the picture data generating unit 18, and a picture showing the whole of the amusement arcade is indicated on the screen of the display unit 20. FIG. 14 is the picture obtained.

As shown in FIG. 14, on the screen 1400 of the display unit 20, the one side island modules 1402 etc. based on the data set by the island information setting unit 30 are indicated. In this example, the island modules indicated in FIG. 14 is based on the independent island restoration method. In the island modules, the play machine modules 1404, 1406, . . . set by the play machine information setting unit 24 are located. Further, in the island module 1402, the just counter module 1408 based on the data set by the peripheral machine information setting unit 26 is located.

Next, the data set by a move route deciding unit 32 will be explained. The move route deciding unit 32 sets the information for deciding the move route of the player so that the operator may see the movement of the player during the execution of the simulation.

Figure 15:
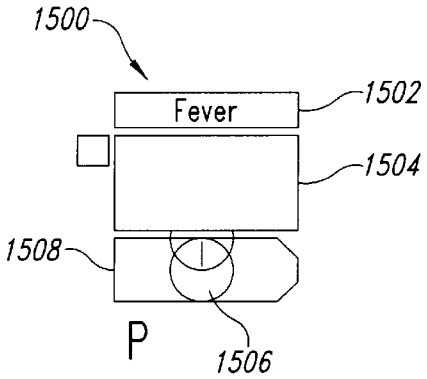
FIG. 15 is an illustration of a play machine module shown on the screen of the display unit referring to the first embodiment.
Figure 16A:
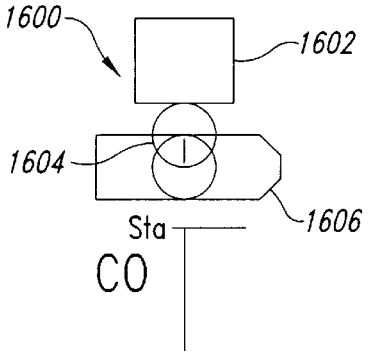
FIG. 16 is an illustration of a counter module and a money changer module shown on the screen of the display unit referring to the first embodiment.
Figure 16B:
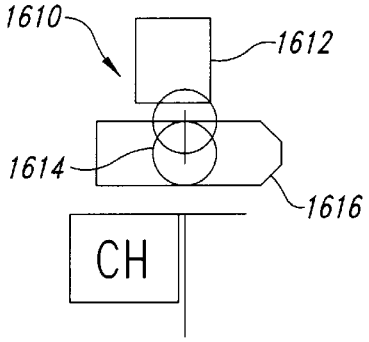

In the first embodiment, the base of movement of the player during the simulation, that is, the point from which it is decided that the player moves to the other point, is referred to as a station. In the first embodiment, a station is located in the predetermined position of each module. For example, as shown in FIG. 15, the play machine module 1500 indicated on the screen of the display unit 20 consists of a symbol 1502 indicating the type of the play machine in compliance with the play machine type data, a symbol 1504 indicating the operating condition which will be described later, a symbol 1506 indicating the position of the player, etc., and the station 1508 of the play machine in the predetermined position. Also, as shown in FIGS. 16(*a*) and 16(*b*), the counter module 1600 and the money changer module 1610 indicated on the screen of the display unit 20 consist of, respectively, the symbols 1602 and 1612 indicating the operating condition, and the symbols 1604 and 1614 indicating the positions of the player, etc., and the stations 1606 and 1616 at the predetermined positions.

Figure 17:
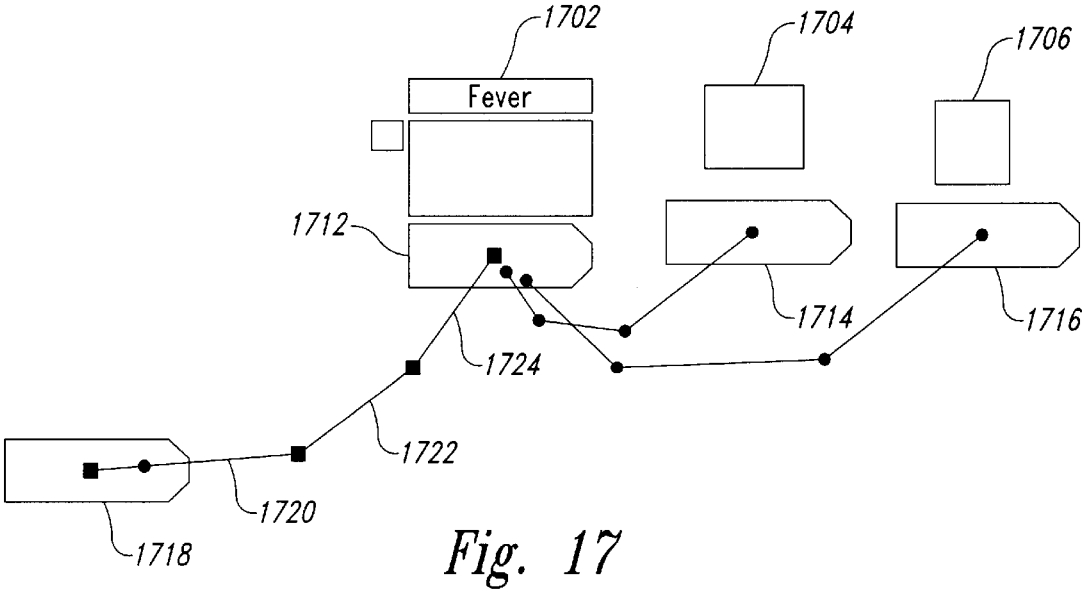
FIG. 17 is an illustration for the explanation of path of flow between stations referring to the first embodiment.

The operator draws a bent line or a straight line between the stations of respective modules indicated in the screen of the display unit 20, and the bent line or the straight line makes the move route of the player between the stations. For example, as shown in FIG. 17, when the predetermined modules 1702, 1704 and 1706, the relevant stations 1712, 1714 and 1716, and the station 1718 relating to the island module are located on the screen of the display unit 20, the operator can draw the straight lines or the bent lines 1720, 1722, . . . by means of the input apparatus.

The move route data indicating the bent lines or the straight lines which connect these stations (for example, in the first embodiment, the coordinates data indicating the coordinates of the terminal points of a line segment) are stored in the predetermined area of the parameter memory unit 14 together with the data indicating the stations with which the lines connect.

Thus, during the simulation, the operator can see the movement of the player by setting the move route which connects stations located at respective modules.

As mentioned above, when the predetermined parameter is set by the parameter setting unit 12 and the operator inputs, by means of the input apparatus 17, the information for starting the simulation, the simulation executing unit 16 is started.

The simulation executing unit 16 is set by the parameter setting unit 12 and composed to count the data, by each unit time, referring to the position of the player module, the operating condition of the play machine module, and the operating condition of the peripheral machine module, on the basis of the various data stored in the parameter memory unit 14.

For example, the simulation executing unit 16 executes the simulation referring to the player module, on the basis of the following general logic. That is, when a player module arrives at the amusement arcade, it selects a predetermined play machine module in accordance with the play machine selection data, and moves to the play machine module on the basis of the move route which is set in advance between the stations. In this case, if there is no vacancy of the play machine module, it stands in a line at the entrance of the amusement arcade to wait for an unoccupied play machine module. It can be executed by disposing the waiting queue referring to the player module waiting for the unoccupied play machine module, and by incrementing the waiting queue.

Next, after arriving at the play machine, the player changes money, by the amount based on the money change unit data, to buy the play media and uses the play machine with the play media.

Further, the player module moves to the counter module to count the obtained play media at a predetermined time, for example, if the play machine module used by the player module is the so-called "fever type table", when the fever ends, and if the used play machine module is the so-called "rights type table", when the rights end. At this time, if the time exceeds the play time based on the play time data, the player module ends the play. On the other hand, if the time does not exceed the play time, it returns to the same play machine module to continue the play.

If the player module spends money by the amount corresponding to the maximum expense data, the player module ends the play.

Figure 18A:
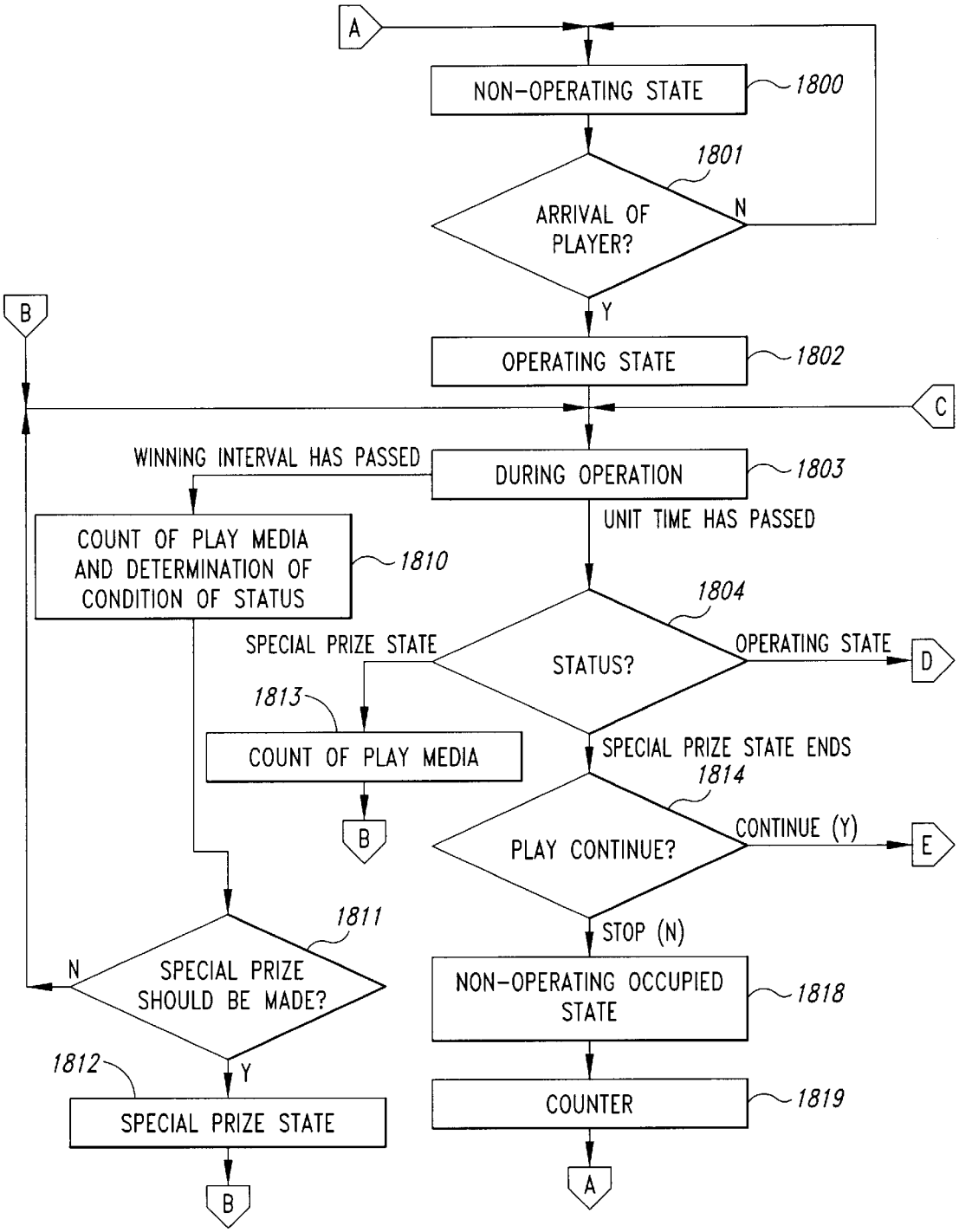
FIG. 18 is a flow chart indicating the operation of a simulation executing unit referring to the first embodiment.
Figure 18B:
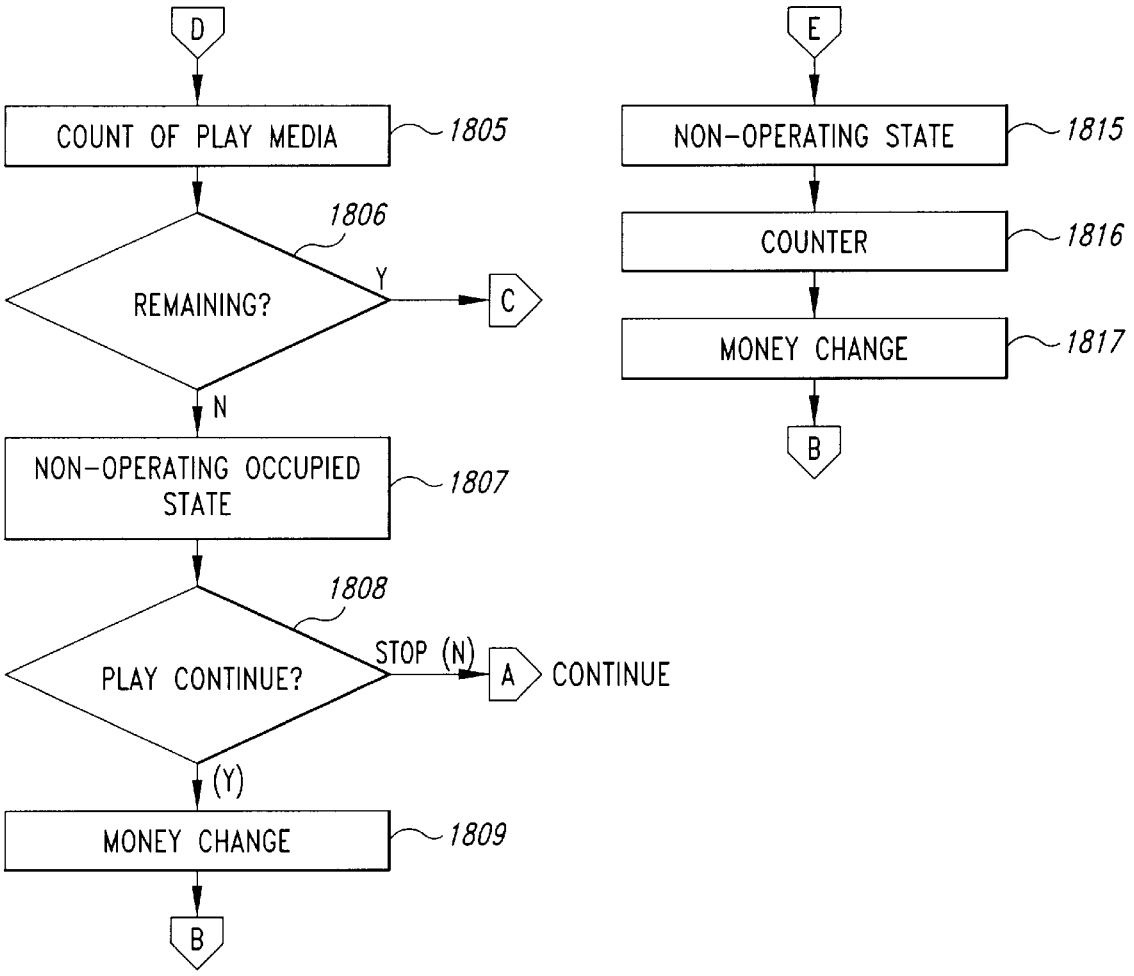

Corresponding to the above mentioned logic relating to the player module, the play machine module operates as indicated in the flow chart of FIG. 18, under the control of the simulation executing unit 16. In the first embodiment, during the simulation, each play machine module has its status indicating its operating condition. This status indicates, for example, that the play machine module is not in operation and is not occupied by the player module (it is called "a non-operating state" in the following.), that the play machine module is not in operation but is occupied by the player module (it is called "a non-operating occupied state" in the following.), that the play machine module is in operation (it is called "an operating state" in the following.), that the play machine module is winning (it is called "a winning state" in the following.), and that, for example when the play machine is the so-called "fever type table", the play machine module is in a state indicating "in a fever" (it is called "a special prize state" in the following.). The status is changed in accordance with the arrival of the player module to a certain play machine module, etc.

As shown in FIG. 18, when the simulation is started by the simulation executing unit 16, the status of the play machine module is in a non-operating state (step 1800), and whether or not the player module has arrived is judged (step 1801). As mentioned above, the arrival of the player module to the play machine module is determined in accordance with the operating rate data. When it is judged that the player module has arrived, the status of the play machine module is changed to an operating state (step 1802) and the play machine module operates (step 1803). At the step 1803, if the status of the play machine module is in a non-operating state or in a non-operating occupied state, the status is changed to an operating state.

When the unit time for executing the simulation has passed, the status of the play machine module is examined (step 1804), and if it is in a operating state, the number of play media given to the play machine module during the unit time (it is called "the number of incoming balls") is counted (step 1805), and whether or not the play media held by the player module exist is judged (step 1806). If the play media exist (in the case of yes (Y) at the step 1806), the process returns to the step 1803 and the same process is repeated.

On the other hand, if it is judged as no (N) at the step 1806, the player module judges whether or not the play is to be continued (step 1808). That is, to put it concretely, it is judged whether or not the player module fulfills the conditions to continue the play, referring to the maximum expense data, the play time data, etc. At the step 1808, if it is judged to stop the play, the process returns to the step 1800, and the status of the play machine module becomes a non-operating state. On the contrary, if it is judged to continue the play at this step, the status of the play machine module becomes a non-operating occupied state (step 1807). Then, the player module is made to move to the money changer module, to change money by the amount based on the money change unit data, and to buy the play media on the basis of the buying unit data (step 1809). While the player module moves to the changer module on the basis of the money changer move time data, and while the money changer operates on the basis of the money changer processing time data, the play machine module maintains its status in a non-operating occupied state. After the player module returns to the play machine module, the process returns to step 1803 to continue.

At step 1803, if it is judged, on the basis of the play machine type data, that the winning interval has passed, the number of the play media given to the play machine module, that is to say the number of incoming balls, and the number of the play media the player gained (it is called "the number of outgoing balls" are counted and whether or not a special prize state should be made is judged in accordance with the play machine type data (step 1810). In the first embodiment, the judgment of this step 1810 is made on the basis of the probability distribution selected out of the uniform distribution, the triangular distribution, the normal distribution and the exponential distribution, in accordance with the play machine type data.

If it is judged that the special prize state should not be made (in the case of no (N) at the step 1811), the process returns to the step 1803 to repeat. On the other hand, if it is judged that the special prize state should be made, the status of the play machine module is made to be in a special prize state (step 1812).

If the status of the play machine module is in a special prize state by passing through the step 1812, the process goes to the step 1813 via the steps 1803 and 1804. At the step 1813, the play media given to the play machine module and the play media gained by the player are counted. The time for a special prize is determined in advance, and so if the time exceeds this determined time, it is judged, at the step 1804, that the special prize state should be ended. In this case, the player module judges whether or not it continues the play (step 1814).

At this step, if it is judged that the play should be continued, the status of the play machine module becomes in a non-operating occupied state (step 1815). Next, the player module is made to move to the counter module and to count the number of play media the player module gained (step 1816). On the basis of the counter move time data, while the player module moves to the counter module, the play machine module maintains its status in a non-operating occupied state. Further, after that, the player is made to move to the money changer module, to change money by the amount based on the money change unit data, and to buy the play media on the basis of the buying unit data (step 1817). In the same way as the step 1816, on the basis of the money changer move time data, while the player module moves to the money changer module, the play machine module maintains its status in a non-operating occupied state. After the player module returns to the play machine module, the process returns to the step 1803 to continue.

Contrary to this, at the step 1814, if it is judged that the play should be stopped, the play machine module is made to be in a non-operating state (step 1818), and the player module is moved to the counter module to count the number of the play media gained by the player module (step 1819). After such process ends, it returns to the step 1800.

In the same way, referring to the counter module, the money changer module, or the just counter module, the simulation executing unit 16 makes its status an operating state, when the player module arrives at these machines, during the time following the respective processing time data. If there is a waiting queue relating to these peripheral machine modules, the counter waiting queue data or the money changer waiting queue data are referred to, and in a regular case, the player module is made to move, in accordance with the alternative counter data or the alternative money changer data, to go to other counter module or other money changer module.

Thus, the simulation executing unit 16 generates the data relating to the movement of the player module, the number of the play media held by the player module, the status of the play machine module, the money changer module, the counter module, etc. and the like by each unit time, and stores them in a predetermined area of the simulation result memory unit 19 for each unit time.

The simulation executing unit 16 outputs the data, generated for each unit time, to the picture data generating unit 18.

Figure 19:
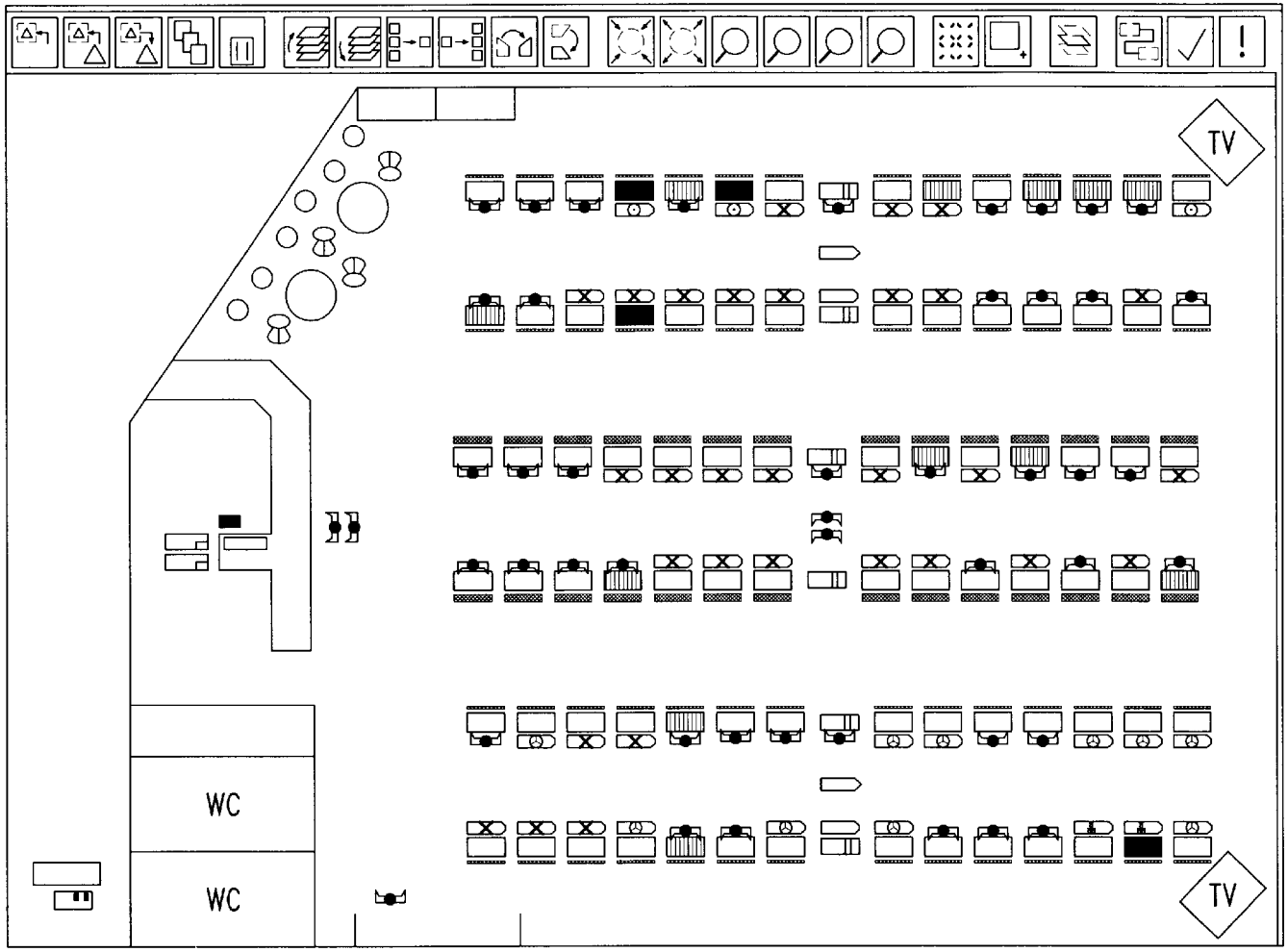
FIG. 19 is an illustration of a state of the amusement arcade at a certain unit time.

The picture data generating unit 18 generates new picture data for each unit time on the basis of the data given by the simulation executing unit 16 and the picture data corresponding to the picture indicated in FIG. 14. FIG. 19 is an illustration indicating the state of the amusement arcade for a certain unit time. As shown in FIG. 19, it can be recognized that the player modules are using the play machine modules, the money changer modules, the counter modules, etc.

Figure 20:
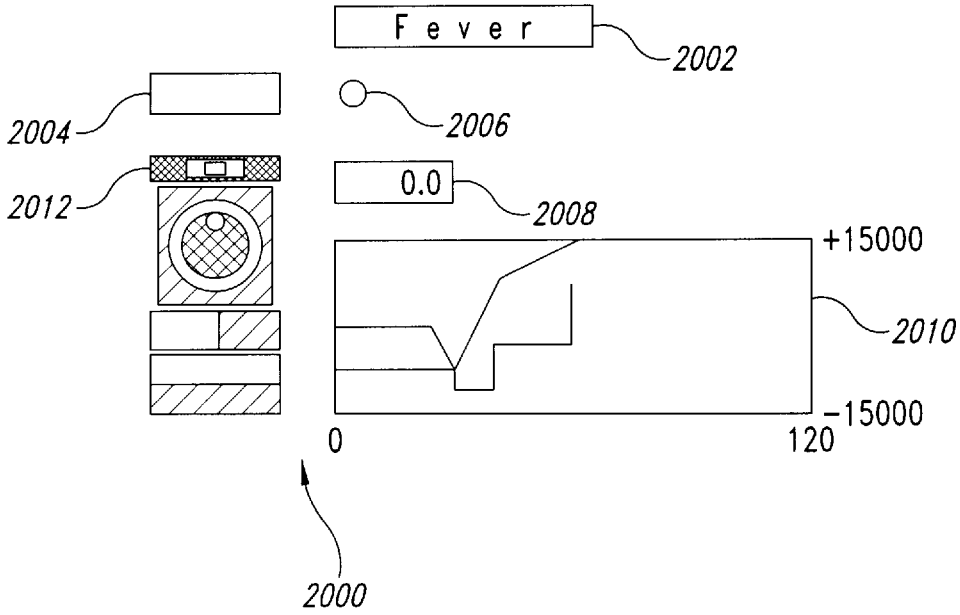
FIG. 20 is an illustration of one example of a picture indicated on the display unit referring to the first embodiment.

Further, the picture data generating unit 18 is composed so that it may generate the picture data corresponding to the picture indicating the details of the play machine on the basis of the data relating to the play machine module out of the data given by the simulation executing unit. That is to say, the picture data generating unit 18 outputs the picture data corresponding to the picture indicated in FIG. 20 to the display unit 20 in accordance with the status of the play machine module, the type of the play machine based on the play machine type data, the transition of the difference between the number of incoming balls and the number of outgoing balls (it is called "the transition of the difference of balls"), etc. Here in FIG. 20, the play machine module 2000 corresponds to the so-called "fever type table", the part 2002 is a symbol indicating the type of the play machine, the part 2004 is a symbol indicating that the probability is changing, the part 2006 is to indicate the number indicating the number of the times of the rights, the part 2008 is to indicate the ratio of the number of giveaway balls to the number of lent balls, and the part 2010 is to indicate the transition of the difference of balls. In the part 2012, the operating state of the play machine module is indicated.

A result analyzing unit 21 is for obtaining the statistical results of the simulation on the basis of the various data obtained by the simulation executing unit 16 as mentioned above, and it is started, after the simulation is ended at the simulation executing unit 16, by the operation, by the operator, of inputting the predetermined information by means of the input apparatus 17. More specifically, the result analyzing unit 21 counts the number of incoming balls, the number of outgoing balls, the difference between the number of incoming balls and the number of outgoing balls (the number of the difference of balls), and outputs the relevant data to the picture data generating unit 18. Further, the result analyzing unit 21 counts the number of incoming balls, the number of outgoing balls, the number of the difference of balls, etc. for each island module or for the whole of the amusement arcade, on the basis of the various data for each play machine module, and outputs the relevant data to the picture data generating unit 18.

The picture data generating unit 18 generates the picture data based on the data given from the result analyzing unit 21 and outputs them to the display unit 20. The picture based on the data generated by the result analyzing unit 21 is indicated in FIG. 21.

As shown in FIG. 21, the data obtained by the result analyzing unit 21 includes the number of the operating tables based on the independent island restoration method or based on the overall restoration method, the total of lent balls indicating the total of the lent play media, etc.

According to the first embodiment, the parameter relating to the play machine etc. constituting the amusement arcade is set by the parameter setting unit 12, and in accordance with the set parameter, the operating condition of the play machine etc. for each unit time can be obtained by the simulation executing unit 16. Further, the picture indicating the condition of the amusement arcade for each unit time is indicated on the screen of the display unit 20. Thus, the operator can grasp the condition of the play machine easily.

Also according to the first embodiment, the statistical results of the simulation can be obtained by the result analyzing unit 21 on the basis of the data obtained by the simulation executing unit 16, and so the operator can more easily inspect the properties of the amusement arcade.

Further, according to the first embodiment, the information referring to the player is set by the parameter setting unit 12, and on the basis of this information, the movement of the player for each unit time during the simulation by the simulation executing unit 16 is determined and the movement of the player is indicated on the screen of the display unit 20, which makes it possible for the operator to grasp the flow of the player easily.

Next, a second embodiment of the present invention will be explained. In the second embodiment, the amusement arcade means the place for playing slot machine and the play machine means the slot machine. The structure of the simulation system for the amusement arcade referring to the second embodiment is the same as the one indicated in FIG. 1.

Also in the second embodiment, as shown in FIG. 2, the parameter setting unit 12 comprises a definition information setting unit 22, a play machine information setting unit 24, a peripheral machine information setting unit 26, a player information setting unit 28, an island information setting unit 30, and a move route setting unit 32. Their functions are almost the same as in the first embodiment, except for the following points.

In the definition information setting unit 22 of this embodiment, the selection as to whether the play media used in the amusement arcade, for example medals, are circulated manually (manual method) or are circulated automatically (automatic method) can be made.

When the automatic method is selected at the definition information setting unit 22, the play machine module and the island module which are possible to be set by the parameter setting unit 12 is to adopt one of the two, that is, "the independent island restoration method" and "the overall restoration method". On the other hand, when the manual method is selected at the definition information setting unit 22, the play machine module and the island module which are possible to be set by the parameter setting unit 12 are to adopt "the overall restoration method".

In the latter case, in the actual amusement arcade, hoppers, tanks, etc. for containing medals are disposed in the respective slot machines, and when a hopper of some slot machine is filled with medals or becomes empty, the lamp disposed on the slot machine is lit up and a personnel removes or supplies the medals, and so in such a method the play machine module etc. also adopt "the overall restoration method".

In the parameter setting unit 12 composed in such way, the simulation time data, the exit data, the play machine name data, the play machine type data, the belonging island name data, the counter name data, the counter processing time data, the play time data, the maximum expense data, the buying unit data, etc. are determined in almost the same way as in the first embodiment.

Figure 22:
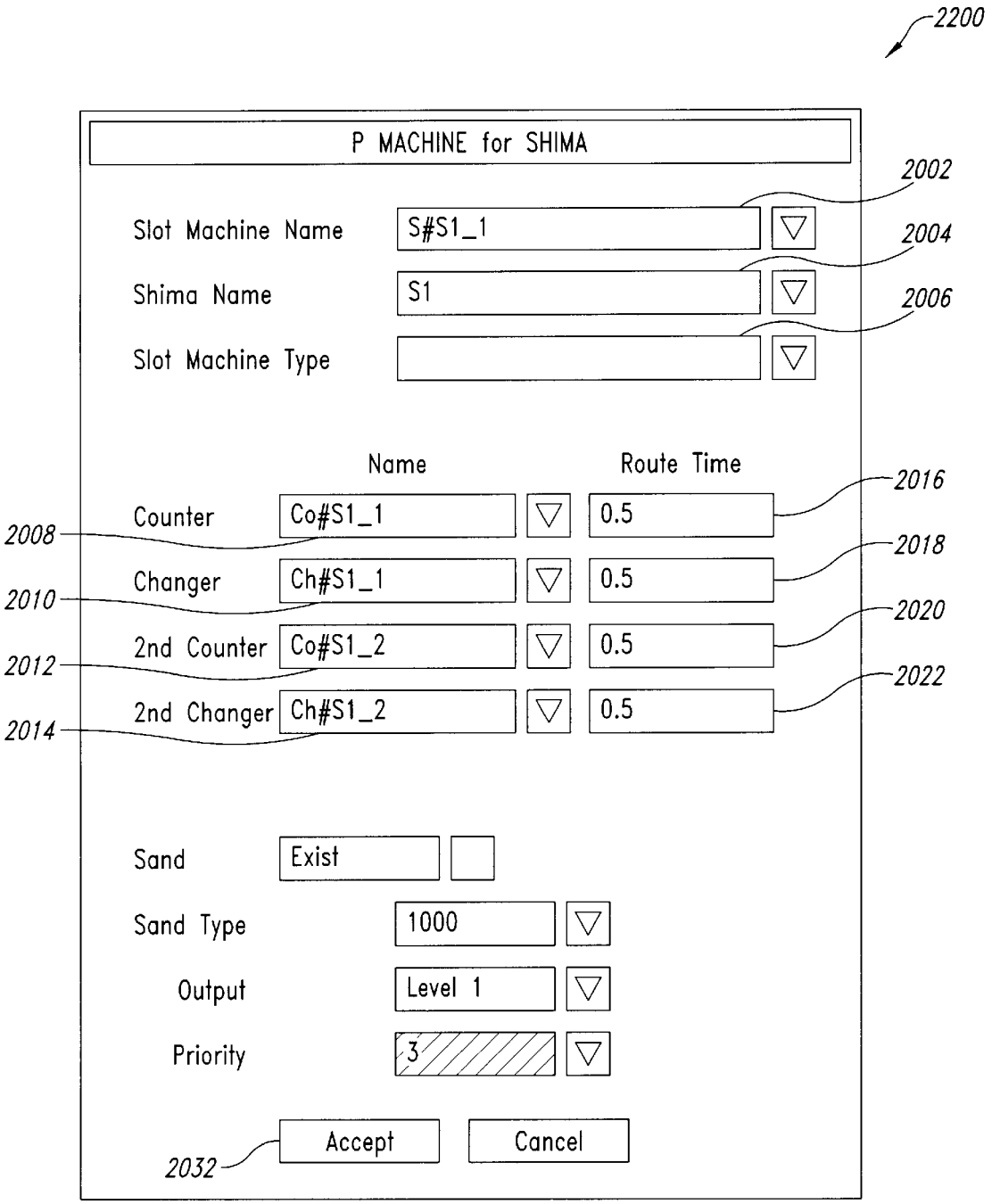
FIG. 22 is an illustration of a picture on the screen of the display unit indicated by the start of a play machine information setting unit of the parameter setting unit referring to the second embodiment.

For example, as shown in FIG. 1, when the play machine information setting unit 24 of the parameter setting unit 12 is started and the predetermined information is given from the parameter setting unit 12 to the picture data generating unit 18, in accordance with the picture data generated on the basis of the information, the picture indicated in FIG. 22 can be obtained on the screen of the display unit 20.

The picture indicated in the FIG. 22 can be recognized as almost the same as the example of the picture indicated in FIG. 4. When the operator operates the input apparatus 17 indicated in FIG. 1 and inputs some information, the characters, the figures, etc. corresponding to the inputted information are indicated in the parts 2002, 2004, etc. of the screen 2200. In FIG. 22, the characters etc. indicated in the parts from 2002 to 2014 correspond to the play machine name data, the belonging island name data, the play machine type data, the first use counter data, the first use money changer data, the second use counter data, the second use money changer data respectively, and the figures indicated in the parts from 2016 to 2022 correspond to the move time data included in the first use counter, the first use money changer data, the second use counter data, and the second use money changer data.

The operation of the input apparatus 17 by the operator gives necessary characters, figures, etc. to the predetermined parts of the screen 2200, and then, if the part 2032 of the screen 2200 is designated by the operation of the input apparatus 17 by the operator, the data corresponding to the characters, figures, etc. given to the respective parts are stored in a predetermined area of the parameter memory unit 14.

The other necessary information is also given by the operation of the input apparatus 17 by the operator, in the same way as in the first embodiment, and is stored in a predetermined area of the parameter memory unit 14.

After the necessary parameter, relating to the machines and the player necessary for the amusement arcade, and the move route data indicating the move route of the player are set, if the operator operates the input apparatus 17 to give the information for starting the simulation, the simulation executing unit 16 is started.

The operation of the simulation executing unit 16 is also the same as in the first embodiment. It will be explained again as follows. The simulation executing unit 16 is set by the parameter setting unit 12, and works out the data referring to the position of the player module, the operating condition of the play machine module, and the operating condition of the peripheral machine modules, for each unit time, on the basis of various data stored in the parameter memory unit 14.

For example, the simulation executing unit 16 executes the simulation referring to the player module on the basis of the following general logic. That is to say, first, when a certain player module arrives at the amusement arcade, it selects a predetermined play machine module in accordance with the play machine selection data, and moves to the play machine module on the basis of the move route set between stations in advance. In this case, if there is no vacant play machine module, the player module stands in a line at the entrance of the amusement arcade to wait for the unoccupied play machine module. It can be executed by locating the waiting queue referring to the player module waiting for the unoccupied play machine module, and by incrementing the waiting queue.

Next, after arriving at the play machine, the player changes money, by the amount based on the money change unit data, to buy the play media and uses the play machine with the play media.

Further, when the time in which the play machine module should maintain the winning state has passed, the player module moves to the counter module to count the gained play media. At this time, if the time exceeds the play time based on the play time data, the player module ends the play. On the other hand, if the time doesn't exceed the play time, it returns to the same play machine module to continue the play. If the player module spends money by the amount corresponding to the maximum expense data, the player module ends the play.

Figure 23:
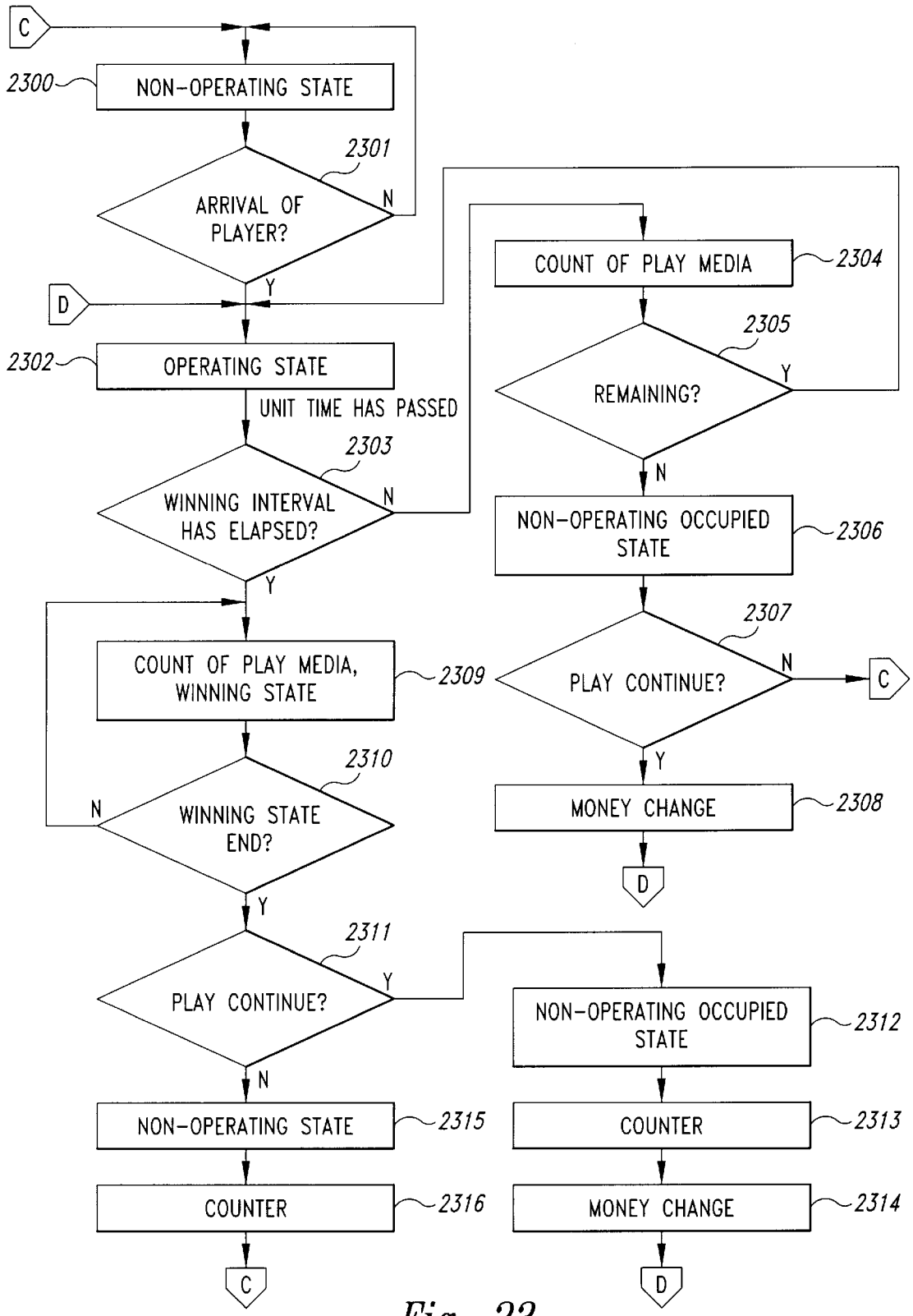
FIG. 23 is a flow chart indicating the operation of a simulation executing unit referring to a second embodiment.

More concretely, the simulation executing unit 16 executes the simulation in accordance with the flow chart indicated in FIG. 23.

As shown in FIG. 23, when the simulation is started by the simulation executing unit 16, the status of the play machine module is in a non-operating state (step 2300) and whether or not the player module arrives at the play machine module is judged (step 2301). In the same way as in the first embodiment, the arrival of the player module at the play machine module is determined in accordance with the operating rate data. If it is judged that the player module has arrived, the status of the play machine module is changed into an operating state (step 2302).

As the unit time for executing the simulation has elapsed, whether or not the time corresponding to the winning interval has elapsed is judged (step 2303). If it is judged as no (N) at this step 2303, the number of the play media given to the play machine module, that is, the number of the incoming balls, for the unit time is counted (step 2304) and whether or not play media are being held by the player module is judged (step 2305). If play media are being held (yes (Y) at the step 2305), the process returns to the step 2302 to continue.

If it is judged as no (N) at the step 2305, the status of the play machine module is changed into a non-operating occupied state (step 2306) and then, whether or not the player module is to continue the play is judged (step 2307). To put it concretely, in the same way as in the first embodiment, referring to the maximum expense data, the play time data, etc., whether or not the player module fulfills the conditions for continuing the play is judged.

At the step 2307, if it is judged that the play is to be stopped (as no (N)), the process returns to the step 2300 and the status of the play machine module becomes a non-operating state. At this step, if it is judged that the play is to be continued (as yes(Y)), the player module is made to move to the money changer module to change money by the amount based on the money change unit data and to buy the play media on the basis of the buying unit data (step 2308). While the player module moves to the money changer module on the basis of the money changer move time data and while the money changer operates on the basis of the money changer processing time data, the play machine module maintains its status in a non-operating occupied state. After the player module returns to the play machine module, the process returns to the step 2302 to continue.

At the step 2303, if it is judged that the time corresponding to the winning interval has gone by, the status of the play machine module becomes a winning state, and the number of the play media given to the play machine module, that is, the number of incoming balls, and the number of the play media the player has gained, that is, the number of outgoing balls, are counted in accordance with the winning type.

As the winning time is determined in advance, if the time has gone by (yes (Y) at the step 2310), the process advances to the step 2311 and whether or not the player module is to continue the play is judged.

At this step, if it is judged that the play is to be continued (as yes (Y)), the status of the play machine module becomes a non-operating occupied state (step 2312). Then, the player module is moved to the counter module to count the number of the play media the player module gained (step 2313). On the basis of the counter move time data, while the player module moves to the counter module, the play machine module maintains its status in a non-operating occupied state. Further, the player is than made to move to the money changer module, to change money by the amount based on the money change unit data, and to buy play media on the basis of the buying unit data (step 2314). In the same way as in the step 2313, on the basis of the money changer move time data, while the player module moves to the money changer module, the play machine module maintains its status in a non-operating occupied state. After the player module returns to the play machine module, the process returns to the step 2302 to be continued.

At the step 2311, if it is judged that the play should be stopped, (as no (N)), the play machine module is made to be in a non-operating state (step 2315), and the player module is moved to the counter module to count the number of play media the player module has gained (step 2316). After such a process is finished, the process returns to the step 2300.

In the same way, referring to the counter module, the money changer module, or the just counter module, the simulation executing unit 16 makes its status a operating state during the time following the respective processing time data if the player module arrives at these machines. If there is a waiting queue relating to these peripheral machine modules, the counter waiting queue data or the money changer waiting queue data are referred to, and in a regular case, the player module is made to move, in accordance with the alternative counter data or the alternative money changer data, to go to another counter module or another money changer module.

In the same way as in the first embodiment, the simulation executing unit 16 generates the data, for each unit time, relating to the movement of the player module, the number of the play media held by the player module, the status etc. of the play machine module, the money changer module, the counter module, etc., and memorizes them in a predetermined area of the simulation result memory unit 19 for each unit time.

Thus, also in the second embodiment, the requested simulation can be executed. The simulation executing unit 16 also outputs the data, generated for each unit time, to the picture data generating unit 18.

In the same way as in the first embodiment, the picture data generating unit 18 generates picture data for each unit time on the basis of the data given by the simulation executing unit 16. The picture corresponding to the picture data is indicated on the screen of the display unit 20. This picture is almost the same as the one illustrated in FIG. 19.

Figure 24:
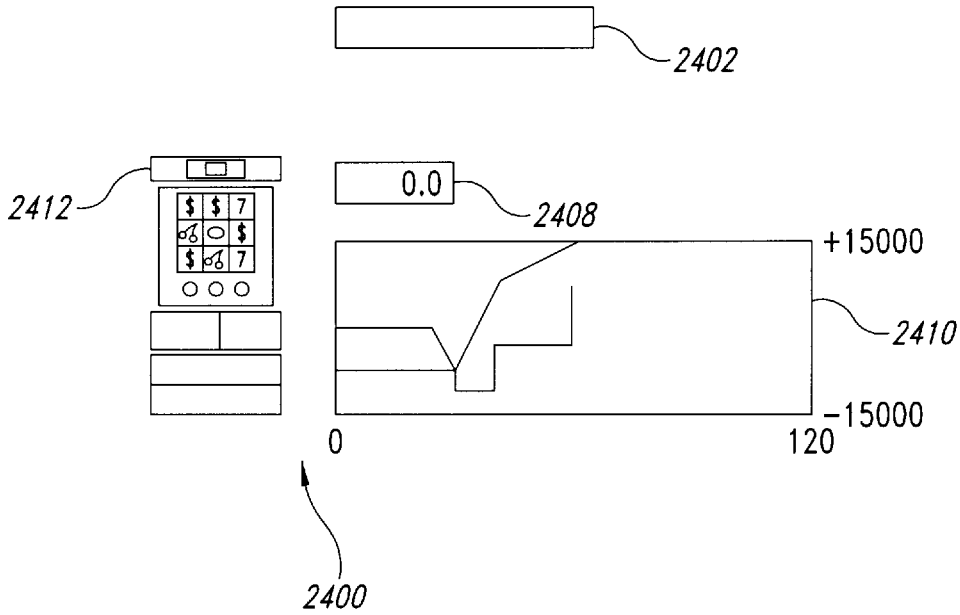
FIG. 24 is an illustration of an example of the picture based on the data generated by a result analyzing unit referring to the second embodiment.

Further, in the same way as in the first embodiment, the picture data generating unit 18 can generate the picture data corresponding to the picture indicating the details of the play machine on the basis of the data relating to the play machine module out of the data given by the simulation executing unit. That is to say, the picture data generating unit 18 outputs the picture data corresponding to the picture indicated in FIG. 24 to the display unit 20 in accordance with the status of the play machine module, the type of the play machine based on the play machine type data, the transition of the difference of balls, etc. On the screen 2400, the part 2402 is a symbol indicating the type of the play machine, the part 2408 is to indicate the ratio of the number of giveaway balls to the number of lent balls, and the part 2410 is to indicate the transition of the difference of balls. In the part 2412, the operating state of the play machine module is indicated.

In the same way as in the first embodiment, the result analyzing unit 21 obtains the statistical results of the simulation on the basis of the various data obtained by the simulation executing unit 16. The picture data generating unit 18 generates the picture data based on the data supplied from the result analyzing unit 21 and outputs them to the display unit 20. Thus the picture based on the data generated by the result analyzing unit 21 is almost the same as in the first embodiment indicated in FIG. 21.

As explained above, it can be understood that the same effects as in the first embodiment can also be obtained in the second embodiment.

Next, a third embodiment of the present invention will be explained. In the third embodiment, the amusement arcade means a gaming center and the play machine means a play machine. The structure of the simulation system for the amusement arcade relating to the third embodiment is the same as the one indicated in FIG. 1.

Also in the third embodiment, as shown in FIG. 2, the parameter setting unit 12 comprises a definition information setting unit 22, a play machine information setting unit 24, a peripheral machines information setting unit 26, a player information setting unit 28, an island information setting unit 30, and a move route setting unit 32. Their functions are almost the same as in the first embodiment, except for the following points.

In the definition information setting unit 22 of this embodiment, selection can be made as to whether the play media used in the amusement arcade, for example medals, are circulated manually (manual method) or circulated automatically (automatic method).

When the automatic method is selected at the definition information setting unit 22, the play machine module and the island module which are possible to be set by the parameter setting unit 12 adopt "the overall restoration method", and when the manual method is selected at the definition information setting unit 22, the play machine module and the island module adopt "the manual restoration method" which will be mentioned later.

Practically, it is normal in the gaming center for coins to be inserted in the play machine for starting the play machine. Therefore, gaming centers exist in which the coins are transported by means of the belt conveyor disposed between the play machines and taken in to a predetermined coin storage apparatus (for example, a safe or the like) for collecting coins. Gaming centers also exist in which a personnel takes out the coins when the coin storage unit of each play machine is filled with the coins. In the third embodiment, the former corresponds to "the overall restoration method" and the latter corresponds to "the manual restoration method".

If the manual method is selected in the definition information setting unit 22, in addition to the same parameter as in the first and second embodiment, the capacity data, indicating the capacity of the storage unit which stores coins as the play media, and the coin taking out time data, indicating the time in which the personnel takes out the coins, are set.

If it is the simulation for the game center which employs play media which are incapable of being exchanged for giveaways, there is no need to set the data relating to the counter module, for example the first use counter data etc., in the play machine information setting unit 24. In the same way, there is no need to set the data relating to the counter module in the peripheral machines information setting unit 26.

As the type of the play machine set by the play machine information setting unit 24, there are, for example, a game in which the player plays against a character in a play, roulette in which the player predicts the outcome of the game, a horse racing game, and a car race.

In the same way as in the first and the second embodiment, the necessary information is given by the operation of the input apparatus 17 by the operator, and the necessary data for the simulation are stored in a predetermined area of the parameter memory unit 14.

After the necessary parameters, relating to the machines and the player necessary for the amusement arcade, and the move route data, indicating the move route of the player, are set, if the operator operates the input apparatus 17 to give the information for starting the simulation, the simulation executing unit 16 is started.

The operation of the simulation executing unit 16 is also the same as in the first embodiment. It will be explained again as follows. The simulation executing unit 16 is set by the parameter setting unit 12, and works out the data referring to the position of the player module, the operating condition of the play machine module, and the operating condition of the peripheral machine modules, for each unit time, on the basis of various data stored in the parameter memory unit 14.

Figure 25:
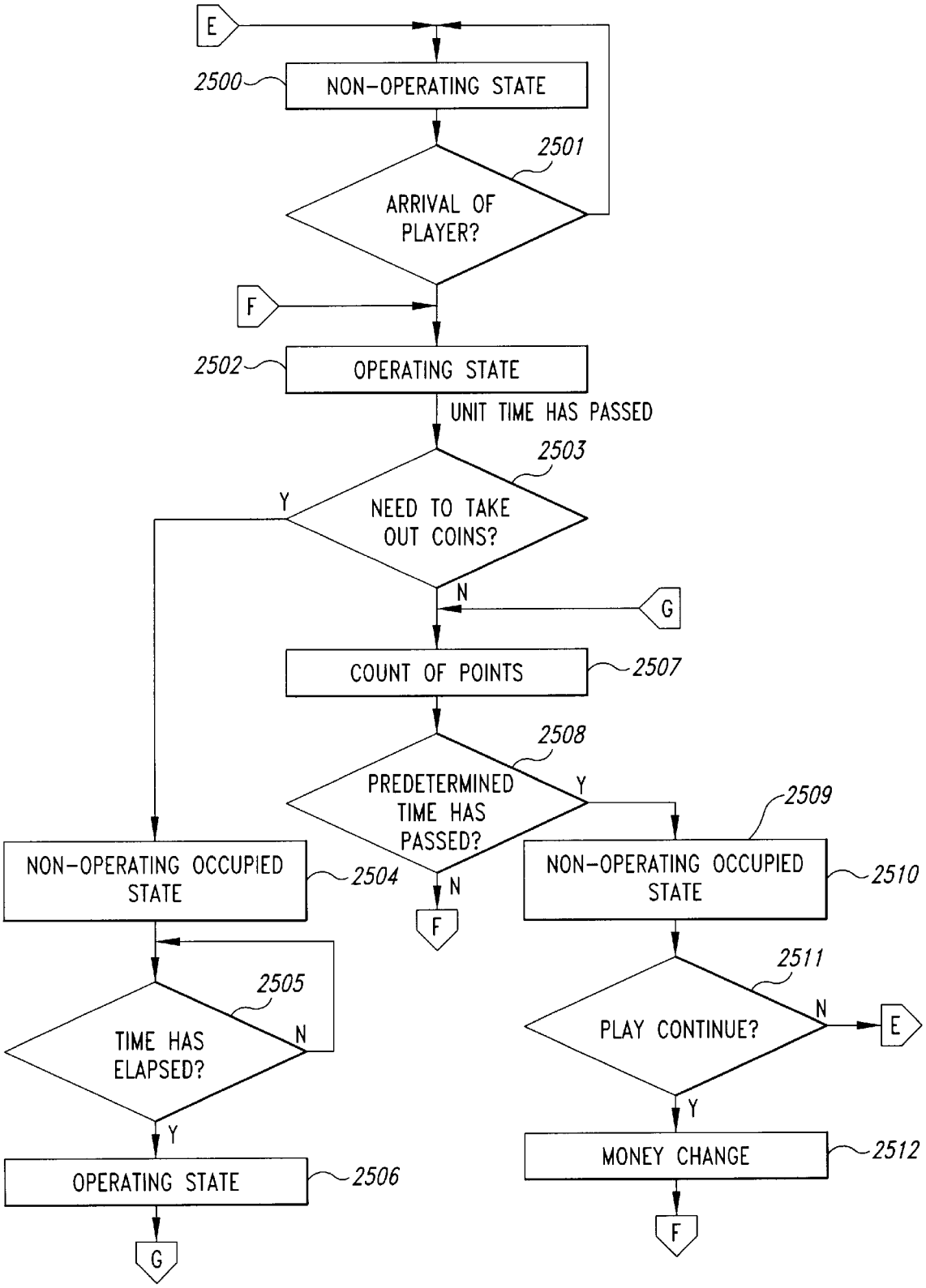
FIG. 25 is a flow chart indicating the operation of a simulation executing unit referring to a third embodiment.

FIG. 25 is an example of the flow chart indicating the processing executed by the simulation executing unit 16 referring to the third embodiment. This flow chart indicates the processing in which the manual method is selected in the definition information setting unit 22.

As shown in FIG. 25, when the simulation is started by the simulation executing unit 16, the status of the play machine module is a non-operating state (step 2500) and whether or not the player module arrives at the play machine module is judged (step 2501). In the same way as in the first embodiment, the arrival of the player module at the play machine module is determined in accordance with the operating rate data. If it is judged that the player module has arrived, the status of the play machine module is changed into an operating state (step 2502).

As the unit time for executing the simulation has elapsed, referring to the capacity data, it is judged whether or not the coin storage unit is full of inserted coins and the coins need to be taken out (step 2503). If it is judged as yes (Y) at this step 2503, the status of the play machine module is changed to a non-operating occupied state (step 2504) and the state is maintained during the time corresponding to the coin taking out time data (step 2505). Then, the status of the play machine module returns to be in an operating state (step 2506) to advance to the step 2507.

Also if it is judged as no (N) at the step 2503, it advances to the step 2507. In the step 2507, in accordance with the type data of the play machine module etc., the points of the play machine are worked out (step 2507). Next, it is judged whether or not it is time for the game on the play machine be finished (step 2508). At this step 2508, if it is judged as no (N), it returns to the step 2502, while if it is judged as yes (Y), it advances to the step 2509.

At the step 2509, the status of the play machine module is changed to a non-operating occupied state (step 2510). Further, it is judged whether or not the player module is to continue the play (step 2511).

At this step, if it is judged as yes (Y), the player is made to move to the money changer module, to change money by the amount based on the money change unit data (step 2512). At this step, on the basis of the money changer move time data, while the player module moves to the money changer module, the play machine module maintains its status in a non-operating occupied state. After the player module returns to the play machine module, the process returns to the step 2502 to be continued. On the other hand, if it is judged as no (N)) at the step 2511, the process returns to the step 2500.

In the definition information setting unit 22, if the automatic method is selected, the processing where the steps from 2503 to 2506 of FIG. 25 are deleted is executed by the simulation executing unit 16.

In the same way as in the first and second embodiment, the simulation executing unit 16 generates the data, for each unit time, relating to the movement of the player module, the number of the play media held by the player module, the status of the play machine module, the money changer module, etc., and stores them in a predetermined area of the simulation result memory unit 19 for each unit time.

Thus, also in the second embodiment, the requested simulation can be executed. Also the simulation executing unit 16 outputs the data, generated for each unit time, to the picture data generating unit 18.

In the same way as in the first embodiment, the picture data generating unit 18 generates picture data for each unit time on the basis of the data supplied by the simulation executing unit 16. The picture corresponding to the picture data is indicated on the screen of the display unit 20. This picture is almost the same as the one illustrated in FIG. 19.

Figure 26:
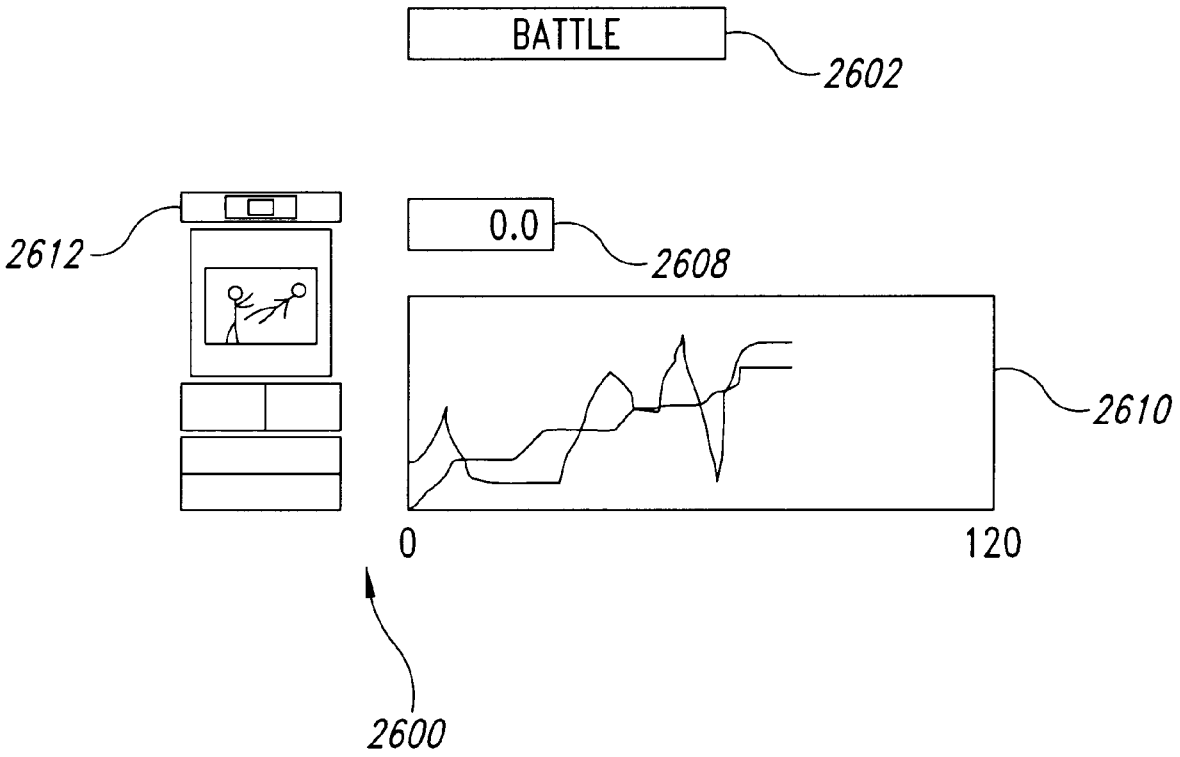
FIG. 26 is an illustration of an example of a picture based on the data generated by a result analyzing unit referring to the third embodiment.

Further, in the same way as in the first embodiment, the picture data generating unit 18 can generate the picture data corresponding to the picture indicating the details of the play machine on the basis of the data relating to the play machine module out of the data given by the simulation executing unit. That is to say, the picture data generating unit 18 outputs the picture data corresponding to the picture indicated in FIG. 26 to the display unit 20 in accordance with the status of the play machine module, the type of the play machine based on the play machine type data, the points gained in the game, the transition of the amount of the inserted coins, etc. On the screen 2600, the part 2602 is a symbol indicating the type of the play machine, the part 2608 is to indicate the points gained in the game, and the part 2610 is to indicate the amount of the inserted coins and the transition of the points gained in the game. In the part 2612, the operating state of the play machine module is indicated.

In the same way as in the first and second embodiment, the result analyzing unit 21 obtains the statistical result of the simulation on the basis of the various data gained by the simulation executing unit 16. In the third embodiment, the statistical result obtained by the result analyzing unit 21 includes the operating rate of the play machine, the highest points of the game, the amount of the coins inserted in the play machine for a predetermined time, etc. The picture data generating unit 18 generates the picture data based on the data given from the result analyzing unit 21 and outputs them to the display unit 20.

According to the third embodiment, the parameter relating to the play machine of the gaming center is set, and in accordance with the set parameter, the operating condition of the play machine for each unit time can be obtained by the simulation executing unit 16. Thus, the operator can grasp the condition of the play machine easily.

According to the third embodiment, the statistical results of the simulation can be obtained by the result analyzing unit 21 on the basis of the data obtained by the simulation executing unit 16, and so the operator can more easily inspect the properties of the gaming center.

As specifically explained above, according to the present invention, it is possible to provide a simulation system for an amusement arcade, which generates a dynamic model relating to the amusement arcade and can inspect an operating condition of play machines, a flow of players and the like.

The present invention is not restricted to the above embodiment, and various modifications can be made within the invention described in the claims, which, it goes without saying, is included within the present invention.

For example, in the embodiment, during the execution of the simulation by the simulation executing unit 16, the corresponding picture is indicated in the display unit 20, but the present invention is not restricted to that and can be modified so as to just obtain the data relating to the simulation result without indicating the picture in the display unit 20.

Also in the embodiment, the data for defining the play machine module and the peripheral machine module respectively are set by the play machine information setting unit 24 and the peripheral machine information setting unit 26, but the present invention is not restricted to that. For example, the present invention can be modified so that the data relating to the number of the play machine module or to the model of one or more island modules where the counter module and the money changer module are disposed may be stored in the parameter memory unit 14 and that the requested data relating to the model of the island module may be read out from the parameter memory unit 14.

Also in the first, the second and the third embodiment, the play machine modules correspond to the pinball machines, the slot machines, and the play machines respectively, but they are not restricted to them, and it goes without saying that, referring to the other play machines such as shooting play machines, poker play machines, medal taking in play machines, the simulation can be executed by the simulation relating to the present invention.

Further, in the present specification, the word "means" does not always mean "physical means", and it also includes the case where the function of each means is realized by software. Also, the function of one means can be realized by two or more physical means or the function of two or more means can be realized by one physical means.

INDUSTRIAL APPLICABILITY

As specifically described above, the present invention can be applied for deciding the positioning of the play machines such as pinball machines, slot machines, game machines etc., the positioning of the peripheral machines such as the money changer etc., or the like in the amusement arcade, by generating a dynamic model of the amusement arcade and by inspecting an operating condition of the play machines, a flow of the players and the like.

We claim:

1. A simulation system for an amusement arcade comprising:

parameter setting means, having play machine setting means for setting a parameter which defines a structure of play machines constituting the amusement arcade, and player setting means for setting a parameter which defines properties of players who use play machines;

simulation executing means for executing simulation of the amusement arcade for each unit time on the basis of the parameter set by the parameter setting means;

resultant data generating means for generating resultant data indicative of a result of simulation on the basis of the data obtained by the simulation executed for a predetermined unit time by said simulation executing means; and display means for indicating a picture corresponding to said resultant data.

2. A simulation system for an amusement arcade according to claim 1, further comprising picture data generating means, which generates picture data based on the parameter set by said parameter setting means, and also generates picture data during the execution of said simulation on the basis of said picture data and the data obtained for each unit time by said simulation executing means.

3. A simulation system for an amusement arcade according to claim 1, wherein said parameter setting means further comprises peripheral machine setting means which defines the structure of peripheral machines disposed in the amusement arcade.

4. A simulation system for an amusement arcade according to claim 2, wherein said peripheral machine setting means is composed so as to define the structure of counters which count play media to be used in play machines and of money changers which change money.

5. A simulation system for an amusement arcade according to claim 1, wherein said parameter setting means further comprises an island setting means which defines the structure of islands disposed with a plurality of play machines in a predetermined arrangement.

6. A simulation system for an amusement arcade according to claim 3, wherein said parameter setting means further comprises move route setting means for setting at least one move route, for the player, between play machines or between a play machine and peripheral machines.

7. A simulation system for an amusement arcade according to claim 1, wherein said player setting means is composed so as to set at least one of, operating rate data indicating the rate of use of play machines by players, player time data indicating a distribution of time of play by players, maximum money amount data indicating the amount of money which players can spend, and buying unit data indicating the number of play media which players buy at a time.

8. A simulation system for an amusement arcade according to claim 7, wherein said player setting means is composed so as to set automatically at least one of, said operating rate data, said player time data, said maximum money amount data, and said buying unit data, in compliance with the condition of the amusement arcade.

9. A simulation system for an amusement arcade according to claim 1, wherein said play machine setting means is composed so as to set the type of play machine, and that said simulation executing means is composed so as to determine the winning interval of a play machine during the simulation on the basis of said set type of play machine.

10. A simulation system for an amusement arcade according to claim 9, wherein play machines correspond to slot machines.

11. A simulation system for an amusement arcade according to claim 9, wherein play machines correspond to play machines.

12. A simulation method for an amusement arcade, comprising:

setting a parameter which defines the structure of play machines constituting the amusement arcade and a parameter which defines properties of players who use the play machines;

executing simulation of the amusement arcade for each unit time on the basis of set parameters;

generating resultant data indicative of a result of simulation on the basis of the data obtained by the simulation executed for a predetermined unit time; and indicating a picture corresponding to said resultant data.

13. A simulation method according to claim 12, wherein the step for setting a parameter sets a parameter which defines the structure of peripheral machines disposed in the amusement arcade.

14. A simulation method according to claim 13, wherein said step for setting the parameter sets at least one move route, for the player, between play machines or between a play machine and peripheral machines.

15. A simulation system according to claim 12, wherein the step for executing the simulation judges the state of a play machine for each unit time, and executes at least one of counting the number of the play media or changing the state, in accordance with said judged state.

16. A simulation system according to claim 15, wherein said state of the play machine includes the state in which the play machine does not operate, the state in which the play machine operates, and the state in which the play machine is winning.

* * * * *